US011320211B2

(12) United States Patent
Liu et al.

(10) Patent No.: US 11,320,211 B2
(45) Date of Patent: May 3, 2022

(54) HEAT TRANSFER DEVICE

(71) Applicant: COOLER MASTER CO., LTD., New Taipei (TW)

(72) Inventors: Lei-Lei Liu, New Taipei (TW); Xiao-Min Zhang, New Taipei (TW); Jen-Chih Cheng, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 102 days.

(21) Appl. No.: 16/119,707

(22) Filed: Aug. 31, 2018

(65) Prior Publication Data

US 2018/0372419 A1 Dec. 27, 2018

Related U.S. Application Data

(63) Continuation-in-part of application No. 15/485,201, filed on Apr. 11, 2017, now Pat. No. 10,345,049.

(51) Int. Cl.

| | |
|---|---|
| ***F28D 15/04*** | (2006.01) |
| ***F28D 15/02*** | (2006.01) |
| ***F28F 21/08*** | (2006.01) |

(52) U.S. Cl.

CPC ..... *F28D 15/046* (2013.01); *F28D 15/0233* (2013.01); *F28D 15/0275* (2013.01); *F28F 21/081* (2013.01); *F28F 2240/00* (2013.01); *F28F 2255/18* (2013.01)

(58) Field of Classification Search

None

See application file for complete search history.

(56) References Cited

U.S. PATENT DOCUMENTS

| | | | | |
|---|---|---|---|---|
| 3,255,702 | A | 6/1966 | Gehrm | |
| 4,058,160 | A * | 11/1977 | Corman | F28D 15/046 165/104.26 |
| 6,738,257 | B1 * | 5/2004 | Lai | F28D 15/0266 165/104.26 |
| 6,796,373 | B1 * | 9/2004 | Li | F28D 15/04 165/104.21 |
| 6,938,680 | B2 | 9/2005 | Garner et al. | |

(Continued)

FOREIGN PATENT DOCUMENTS

| | | | |
|---|---|---|---|
| CN | 100470776 | C | 3/2009 |
| JP | 2007-266153 | A | 10/2007 |

(Continued)

OTHER PUBLICATIONS

Chapter 5: Heat Pipe Manufacturing—Bahman Zohuri (Apr. 2016) (Year: 2016).*

(Continued)

*Primary Examiner* — Jenna M Hopkins

(74) *Attorney, Agent, or Firm* — McDermott, Will & Emery LLP

(57) ABSTRACT

A heat dissipation device, includes a vapor chamber including a heat conduction chamber and a first wick structure, the heat conduction chamber having a recessed portion, and the first wick structure disposed in the heat conduction chamber; and a heat pipe including a pipe body and a second wick structure disposed in the pipe body, the pipe body positioned in the recessed portion of the heat conduction chamber. The first wick structure and the second wick structure are metallically bonded.

30 Claims, 23 Drawing Sheets

(56) References Cited

U.S. PATENT DOCUMENTS 7,443,677 B1 * 10/2008 Zhou ..... F28D 15/0275 165/104.21
8,256,501 B2 9/2012 Nagai et al.
8,720,062 B2 * 5/2014 He ..... H01L 21/4871 29/890.032
8,780,559 B2 * 7/2014 Weaver, Jr ..... H01L 23/427 165/104.21
8,811,014 B2 * 8/2014 Chauhan ..... H01L 23/427 361/700
10,048,015 B1 * 8/2018 Lin ..... F28D 15/046
2003/0010477 A1 1/2003 Khrustalev et al.
2004/0067414 A1 4/2004 Wei et al.
2005/0092465 A1 * 5/2005 Lin ..... F28D 15/0275 165/104.21
2005/0173098 A1 8/2005 Connors
2005/0178532 A1 * 8/2005 Meng-Cheng ..... F28D 15/0233 165/104.33
2006/0162905 A1 * 7/2006 Hsu ..... F28D 15/0233 165/104.26
2007/0193723 A1 * 8/2007 Hou ..... F28D 15/046 165/104.26
2007/0240855 A1 * 10/2007 Hou ..... F28D 15/0233 165/104.26
2007/0272399 A1 * 11/2007 Nitta ..... H01L 23/427 165/185
2008/0036076 A1 2/2008 Ouyang
2008/0144319 A1 6/2008 Chang et al.
2009/0025910 A1 * 1/2009 Hoffman ..... F28D 15/046 165/104.26
2009/0101308 A1 4/2009 Hardesty
2010/0108297 A1 * 5/2010 Chen ..... H01L 23/427 165/104.26
2010/0326629 A1 * 12/2010 Meyer IV ..... F28D 15/0233 165/104.26
2011/0000649 A1 1/2011 Joshi et al.
2011/0220328 A1 * 9/2011 Huang ..... F28D 15/0241 165/104.26
2012/0048516 A1 * 3/2012 He ..... F28D 15/0233 165/104.26
2013/0105131 A1 * 5/2013 Chen ..... F28D 15/046 165/177
2013/0174966 A1 * 7/2013 He ..... F28D 15/046 156/89.11
2013/0340978 A1 12/2013 Agostini et al.
2014/0182819 A1 * 7/2014 Yang ..... F28D 15/04 165/104.26
2014/0311713 A1 10/2014 Wu et al.
2015/0083372 A1 * 3/2015 Yang ..... F28D 15/02 165/104.26
2015/0101784 A1 * 4/2015 Pai ..... F28D 15/0233 165/104.26
2015/0204617 A1 * 7/2015 Thanhlong ..... F28D 15/046 165/104.26
2016/0003555 A1 * 1/2016 Sun ..... F28D 15/0266 165/104.26
2016/0018166 A1 * 1/2016 Ahamed ..... F28D 15/0233 165/104.26
2016/0348985 A1 * 12/2016 Sun ..... F28D 15/0275
2017/0122672 A1 * 5/2017 Lin ..... B23K 1/19
2017/0153066 A1 * 6/2017 Lin ..... F28D 15/0266
2017/0176112 A1 6/2017 Sarraf et al.
2017/0227298 A1 * 8/2017 Sun ..... F28D 15/04
2017/0241717 A1 * 8/2017 Sun ..... F28D 15/04
2017/0292793 A1 * 10/2017 Sun ..... F28F 9/001
2017/0312871 A1 * 11/2017 Lin ..... B23P 15/26
2017/0343297 A1 * 11/2017 Lan ..... F28D 15/0233
2017/0350657 A1 * 12/2017 Yeh ..... F28D 15/0266
2017/0356694 A1 * 12/2017 Tan ..... F28D 15/0266
2018/0023416 A1 * 1/2018 Riaz ..... F01D 17/145 415/1
2018/0066896 A1 * 3/2018 Lin ..... F28D 15/046
2018/0350718 A1 * 12/2018 Lin ..... H01L 21/4882
2019/0049190 A1 * 2/2019 Liu ..... F28D 15/0275
2019/0195567 A1 6/2019 Wang et al.

FOREIGN PATENT DOCUMENTS

TW M517314 U 2/2016
TW 201623901 A 7/2016
TW I639379 B 10/2018
WO 2017195254 A1 11/2017

OTHER PUBLICATIONS

Non-Final Office Action dated Nov. 5, 2020 in U.S. Appl. No. 16/422,562.

* cited by examiner

HEAT TRANSFER DEVICE

CROSS-REFERENCE TO RELATED APPLICATIONS

This non-provisional application is a continuation-in-part of and claims priority under 35 U.S.C. § 120 to U.S. patent application Ser. No. 15/485,201 filed Apr. 11, 2017, the entire contents of which are hereby incorporated by reference.

BACKGROUND

The disclosure relates to a heat dissipation device, more particularly to a heat dissipation device including wick structures in a heat pipe and a vapor chamber that are connected to each other.

DESCRIPTION OF THE PRIOR ART

Generally, a heat transfer device includes a heat transfer plate, a heat pipe and a heat dissipater (e.g., fins and fan) to dissipate heat generated by a heat source. In detail, the heat transfer plate contacts the heat source to absorb heat, and the heat pipe is disposed between the heat transfer plate and the heat dissipater to transfer the heat to the heat dissipater in order to dissipate the heat via the heat dissipater.

In conventional heat transfer devices, wick structures in both the heat transfer plate and the heat pipe are proximate with each other but not connected to each other, which causes the heat transfer plate and the heat pipe to work separately because the wick structures have a larger attraction force to the working fluid than gravity. This situation reduces the flow of the working fluid, causing a decrease in the heat dissipation efficiency of the heat transfer device.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The detailed description and features of the example embodiments are depicted along with drawings in the following. However, the drawings are used for illustration purpose only, so the example embodiments are not limited to the drawings.

Figure 8:
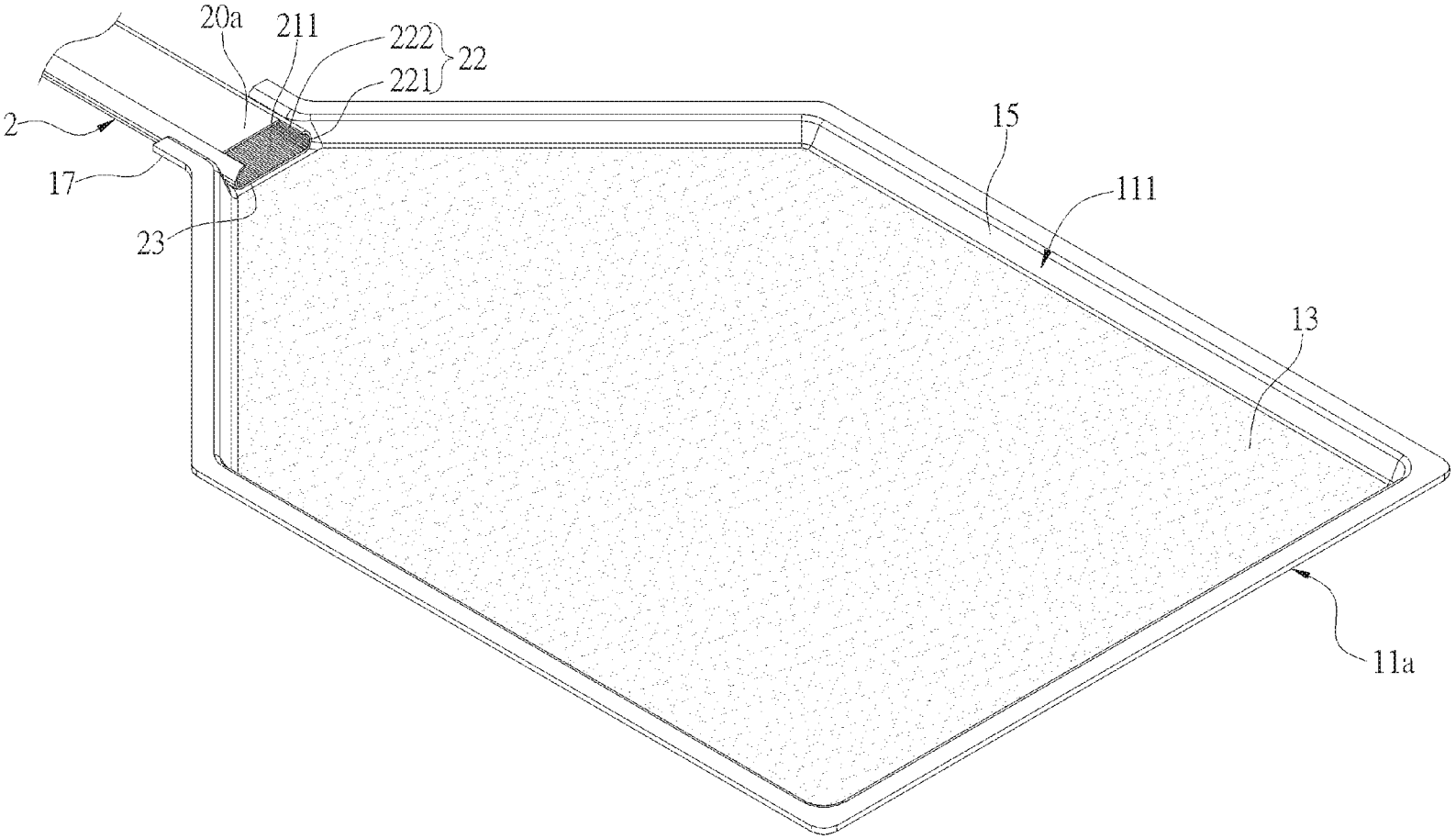
FIG. 8 is a perspective view of a vapor chamber without a cover board, according to example embodiments.
Figure 9:
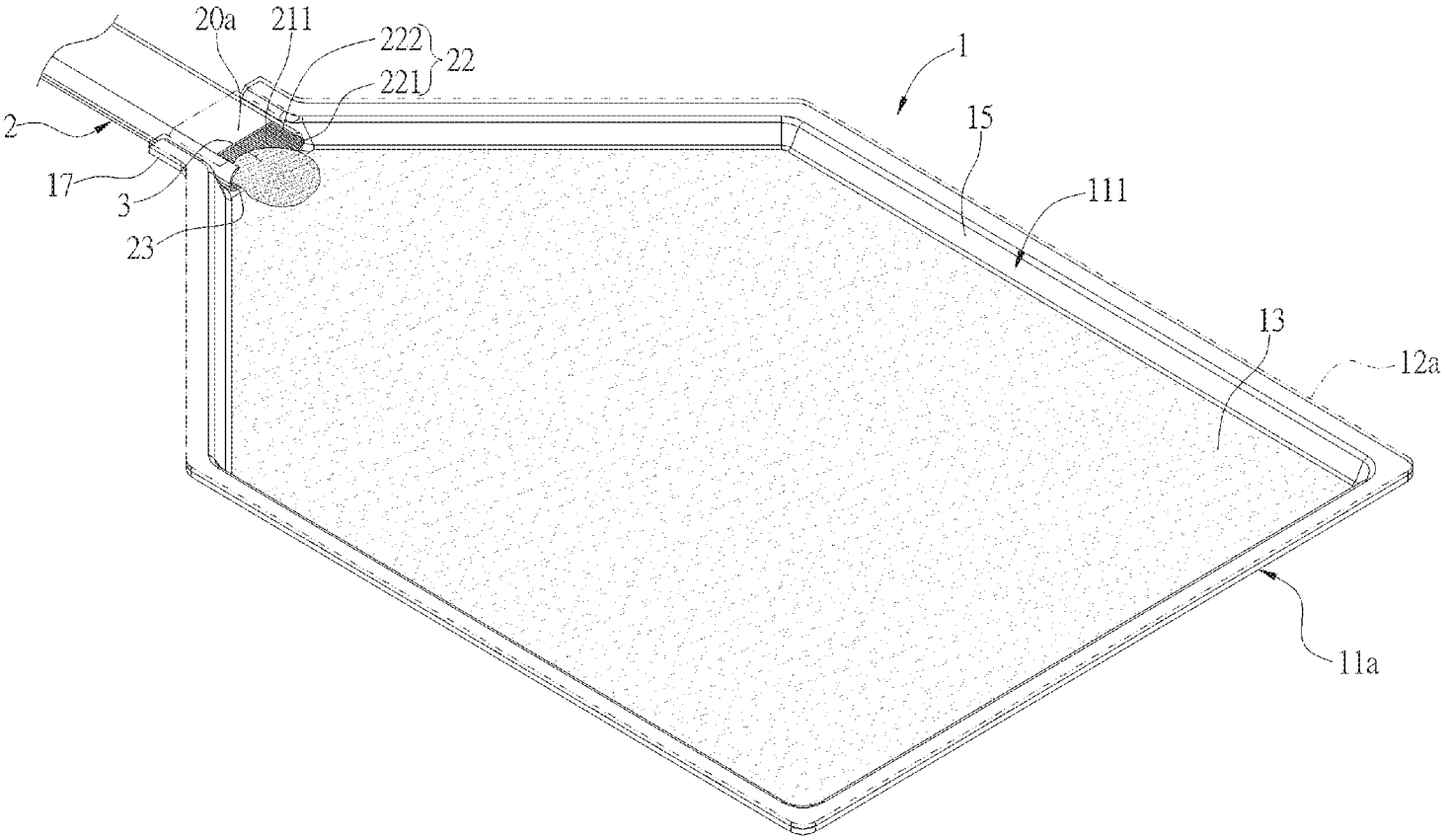
FIG. 9 is a perspective view of a vapor chamber of FIG. 8 including the cover board and a capillary structure, according to example embodiments.
Figure 10:
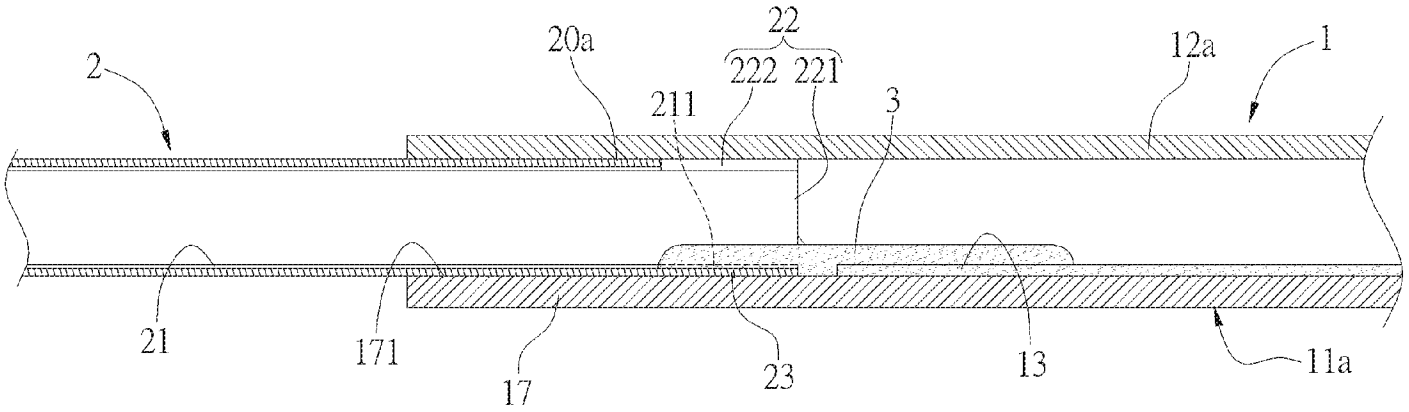
FIG. 10 is a sectional view of the vapor chamber of FIG. 9.

Example embodiments are directed to a communication-type thermal conduction device. FIGS. 1 to 7 illustrate an example embodiment of the communication-type thermal conduction device and FIGS. 8 to 10 illustrate another example embodiment of the communication-type thermal conduction device.

As shown in FIGS. 1 to 7, the communication-type thermal conduction device comprises a vapor chamber 1 and at least one heat pipe 2. The communication-type thermal conduction device further comprises a working fluid (not shown) flowing between the vapor chamber 1 and the heat pipe 2.

Figure 6:
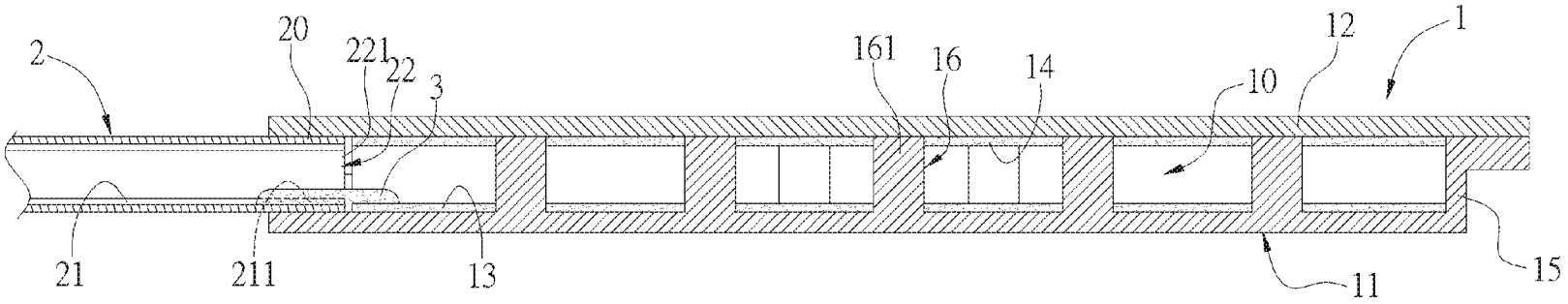
FIG. 6 is a sectional view of the vapor chamber of FIG. 1, according to example embodiments.

The vapor chamber 1 has a bottom board 11 and a cover board 12, wherein the bottom board 11 and the cover board 12 are opposite to each other. After assembling the bottom board 11 and the cover board 12, a chamber 10 (as shown in FIG. 6) is formed between the bottom board 11 and the cover board 12. The vapor chamber 1 may be a structure formed integrally or an assembled structure. In this embodiment, an assembled structure is used for illustrating the example embodiments. That is to say, the cover board 12 can be assembled with the bottom board 11, so as to form the vapor chamber 1 with the chamber 10 therein.

A first capillary structure 13 is disposed on an inner surface of the bottom board 11 and a fourth capillary structure 14 (as shown in FIG. 6) is disposed on an inner surface of the cover board 12, wherein the first and fourth capillary structures 13, 14 are opposite to each other. The first and fourth capillary structures 13, 14 may be powder sintered structures, ceramic sintered structures, metal mesh structures, fiber bundle structures, metal grooves and so on. The first and fourth capillary structures 13, 14 are not limited to any specific structures. The fiber bundle structure is a structure consisting of a plurality of fiber bundles adjacent to each other. However, in some embodiments, the inner surface of the cover board 12 does not have the fourth capillary structure 14 disposed thereon. In other words, only the inner surface of the bottom board 11 has the first capillary structure 13 disposed thereon.

The heat pipe 2 is a hollow tube and a second capillary structure 21 is disposed in the heat pipe 2. One end portion 20 of the heat pipe 2 is connected to the bottom board 11. The end portion 20 has an open portion 22 in communication with the hollow inside of the heat pipe 2 and the chamber 10 of the vapor chamber 1 and for vapor to flow. The second capillary structure 21 has a connected portion 211 exposed by means of the open portion 22.

Figure 3:
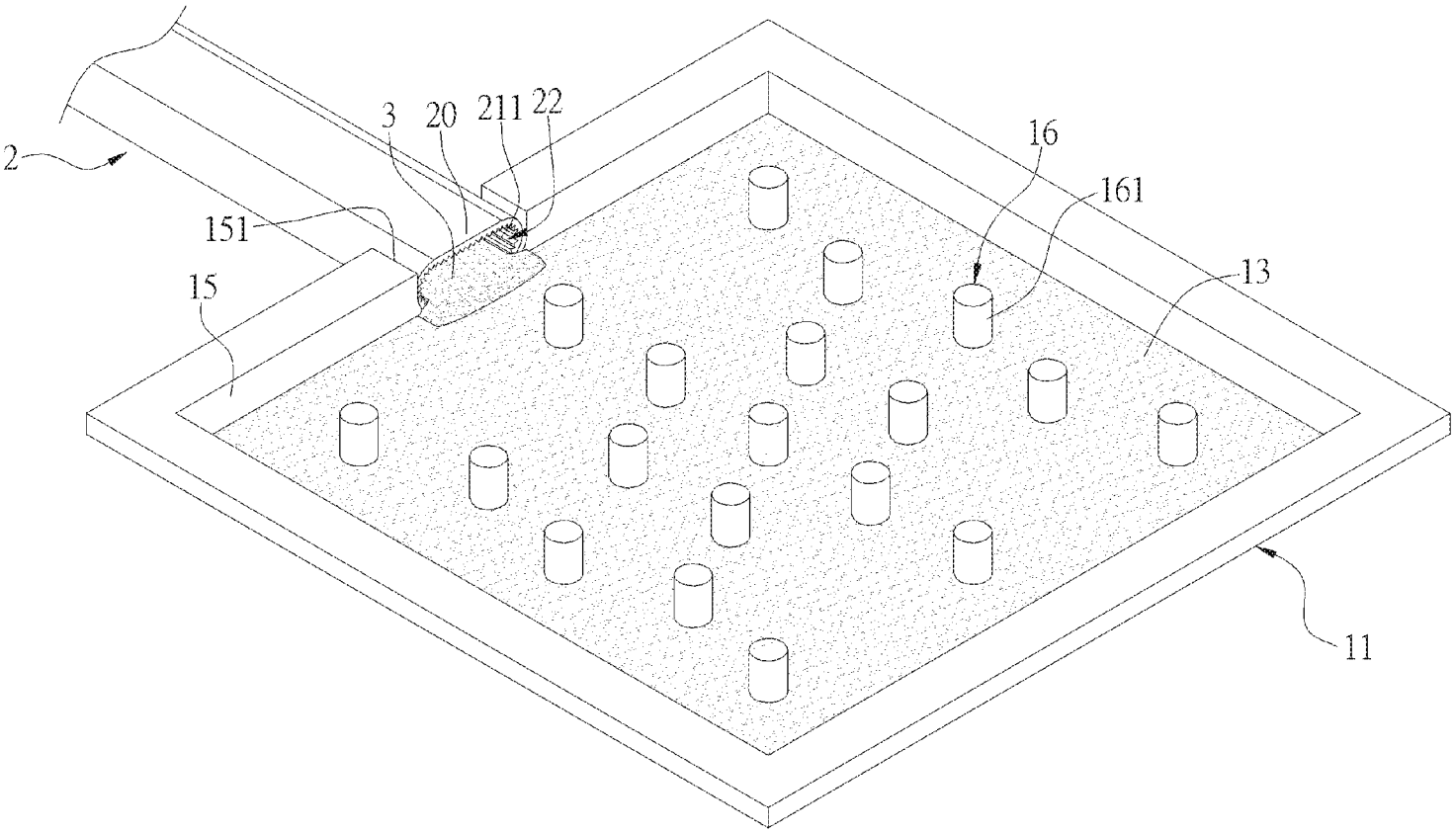
FIG. 3 is a perspective view of a third capillary structure included in the vapor chamber in FIG. 2.

The third capillary structure 3 (as shown in FIG. 3) is connected between the first capillary structure 13 and the connected portion 211 of the second capillary structure 21, so that the first and second capillary structures 13, 21 are in communication with each other. Therefore, the first capillary structure 13 disposed in the vapor chamber 1 and the second capillary structure 21 disposed in the heat pipe 2 can be connected and in communication with each other, so as to achieve holistic thermal conduction. Accordingly, the vapor chamber 1 incorporating the heat pipe 2 can fully provide the desired heat dissipation effect.

Figure 2:
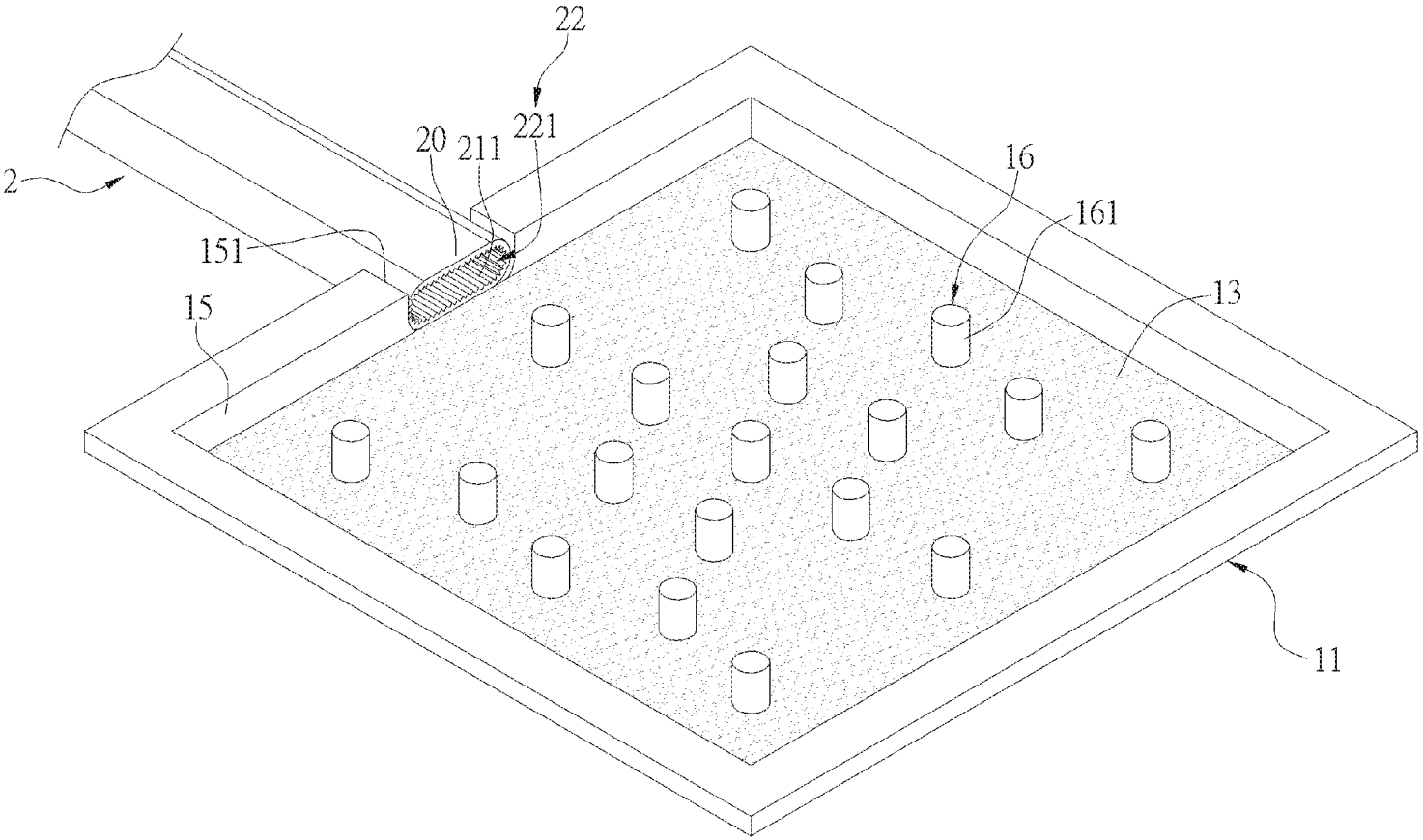
FIG. 2 is a perspective view of the vapor chamber of FIG. 1 without the cover board.

In this embodiment, a surrounding board 15 surrounds a periphery of the bottom board 11, and the end portion 20 of the heat pipe 2 may be inserted into and in communication with the surrounding board 15 (not shown), so that the heat pipe 2 is arranged with the vapor chamber 1 side by side. Alternatively, the surrounding board 15 may have a hole 151 formed therein, and the end portion 20 of the heat pipe 2 may be connected to an inner bottom surface of the bottom board 11 through the hole 151 (as shown in FIG. 2), so that the heat pipe 2 is arranged with the vapor chamber 1 side by side. In detail, for illustration purposes, the so-called "arranged side by side" means that the heat pipe 2 is substantially parallel to the vapor chamber 1. Accordingly, the connected portion 211 of the second capillary structure 21 is also arranged with the first capillary structure 13 side by side, so as to enhance the connection. After the third capillary structure 3 is connected to the first capillary structure 13 and the connected portion 211 of the second capillary structure 21, the first, second and third capillary structures 13, 21, 3 are arranged side by side, so as to be applied to the thin vapor chamber 1 and the flat heat pipe 2.

Furthermore, the open portion 22 of the heat pipe 2 may comprise an opening 221 formed on an end of the heat pipe 2 (i.e. one of both ends of the heat pipe 2) and the connected portion 211 is exposed by means of the opening 221. In detail, for illustration purposes, the so-called "exposed" means that the connected portion 211 does not protrude out of the opening 221. The opening 221 of the heat pipe 2 is in communication with the chamber 10 of the vapor chamber 1, wherein vapor can flow through the opening 221 and the opening 221 is contributive to connect the third capillary structure 3.

Moreover, the third capillary structure 3 may be formed by a powder sintering process manner or a ceramic sintering process and connected between the first capillary structure 13 and the connected portion 211 (as shown in FIGS. 3 to 6). Alternatively, the third capillary structure 3 may be a metal mesh structure or a fiber bundle structure (not shown). In other words, the example embodiments are not limited to any specific structure of the third capillary structure 3.

Figure 4:
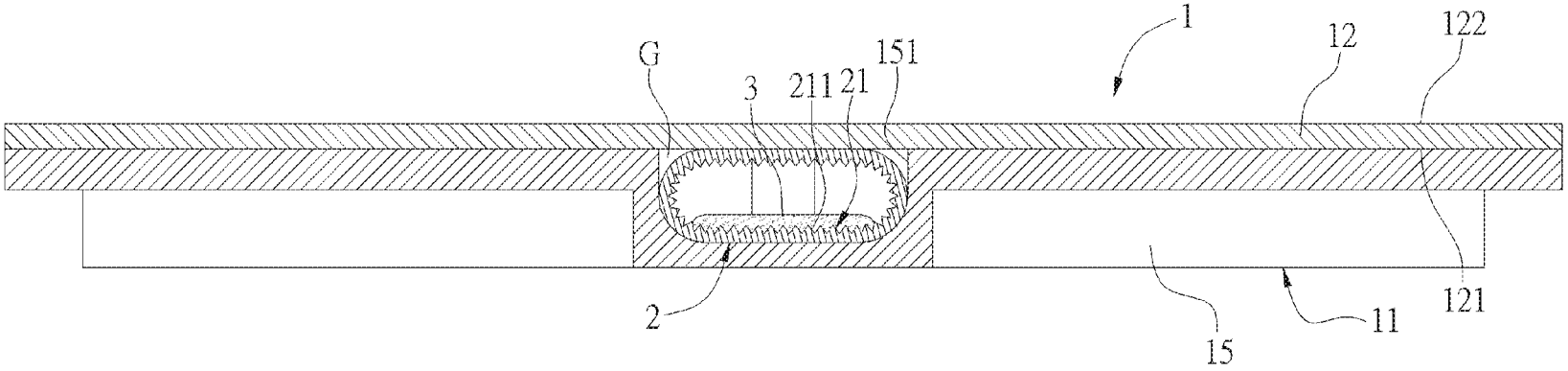
FIG. 4 is a sectional view of the vapor chamber of FIG. 1 prior to the cover board being sunk.
Figure 5:
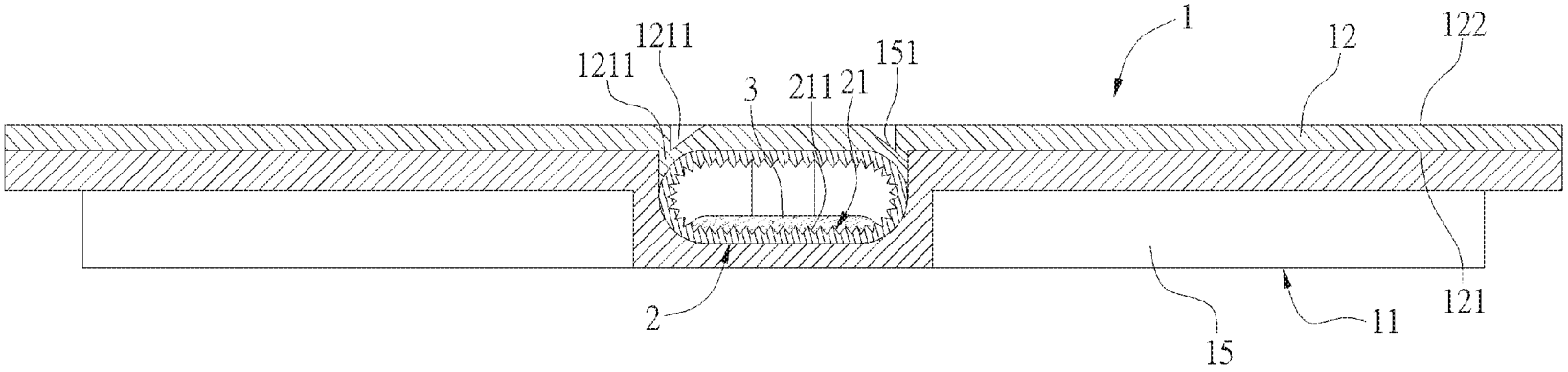
FIG. 5 is a sectional view of the vapor chamber of FIG. 1 after the cover board is sunk.
Figure 7:
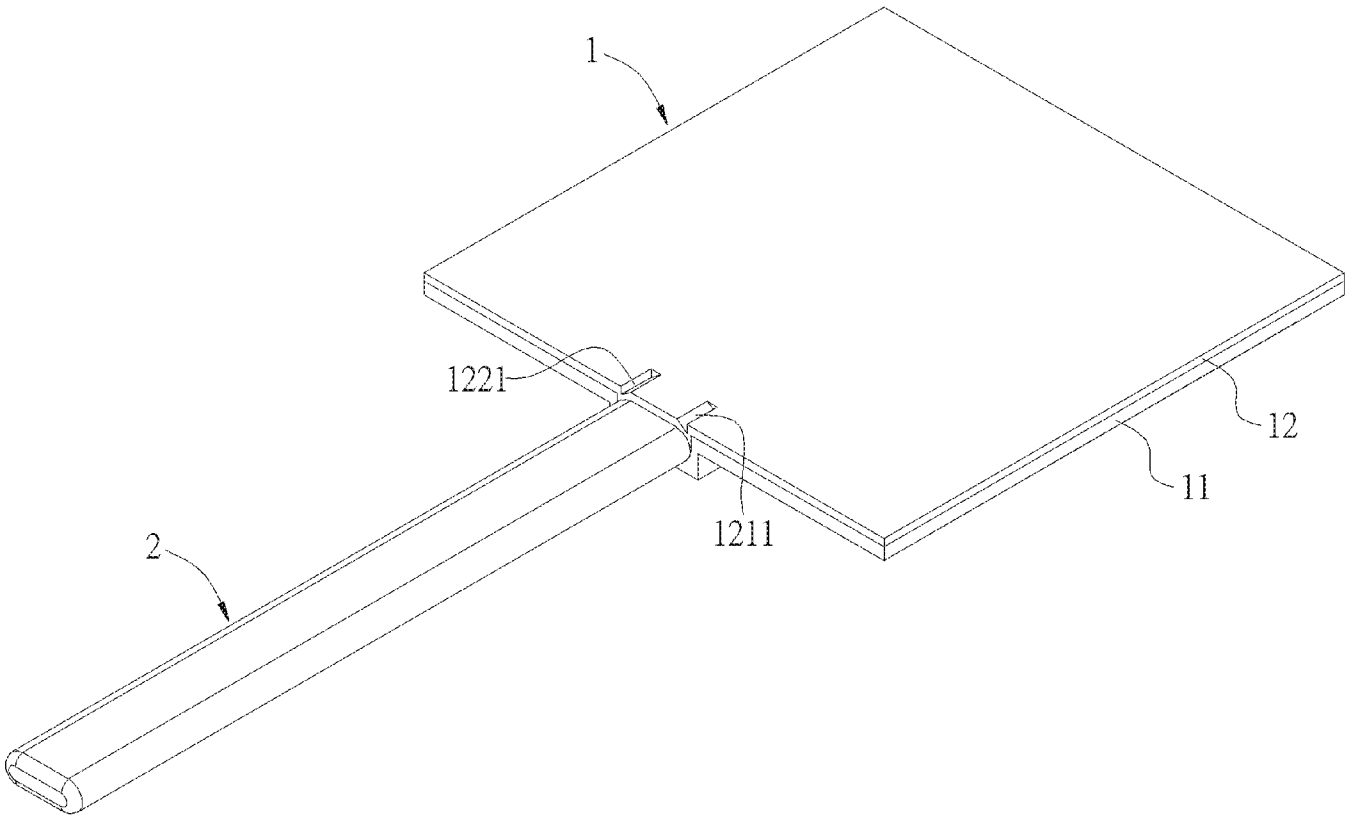
FIG. 7 is a perspective of a vapor chamber, according to example embodiments.

Still further, as shown in FIGS. 4, 5 and 7, the cover board 12 is sealed on an open edge of the surrounding board 15, so as to seal the vapor chamber 1 and form the chamber 10. A gap G is formed between a side of the end portion 20 and the surrounding board 15 corresponding to the hole 151. A filler 1211 is formed on the cover board 12 and corresponds to the gap G and the filler 1211 is filled in the gap G correspondingly. In this embodiment, the filler 1211 is formed by sinking the cover board 12 correspondingly. In detail, the cover board 12 has an inner surface 121 and an outer surface 122 corresponding to each other, and a position of the outer surface 122 of the cover board 12 is sunk to form a recess portion 1221, so that the filler 1211 extends from the inner surface 121 of the cover board 12 integrally. The filler 1211 is filled in the gap G correspondingly, so that the heat pipe 2 can be more suitable for the hole 151 of the vapor chamber 1 and the heat pipe 2 can be welded to the vapor chamber more easily. Needless to say, the filler 1211 may also be an individual object filled in the gap G. In other words, the filler 1211 is not limited to the structure corresponding to the recess portion 1211 and the filler 1211 may be an individual object.

FIGS. 8 to 10 illustrate a communication-type thermal conduction device, according to example embodiments. The communication-type thermal conduction device in FIGS. 8-10 is substantially similar to the communication-type thermal conduction device in FIGS. 1-7, and may be understood with reference thereto. The difference is that the end portion 20*a* of the heat pipe 2 of the second embodiment is different from the end portion 20 of the first embodiment and the vapor chamber 1 of the second embodiment is also different from the vapor chamber 1 of the first embodiment. The details are depicted in the following.

As illustrated, the end portion 20*a* further comprises a breach 222. The breach 222 is formed on a periphery of the end portion 20*a* (i.e. the body of the heat pipe 2), and the breach 222 is connected to and in communication with the aforesaid opening 221, so that the third capillary structure 3 can be connected more conveniently and easily. Accordingly, the end portion 20*a* may form a mandible portion 23 by means of the open portion 22, the connected portion 211 is located at an inner surface of the mandible portion 23, and the connected portion 211 is exposed through the open portion 22 including the opening 221 and the breach 222.

A surrounding board 15 surrounds a periphery of the bottom board 11*a* to form a recess space 111 and a communication neck 17 extends from the bottom board 11*a* and the surrounding board 15 outwardly, so that the communication neck 17 is in communication with the recess space 111 and an outside of the vapor chamber 1. The heat pipe 2 and the mandible portion 23 of the end portion 20*a* thereof are connected to an inner bottom surface 171 of the communication neck 17, so as to enhance the connection of the heat pipe 2.

Figure 1:
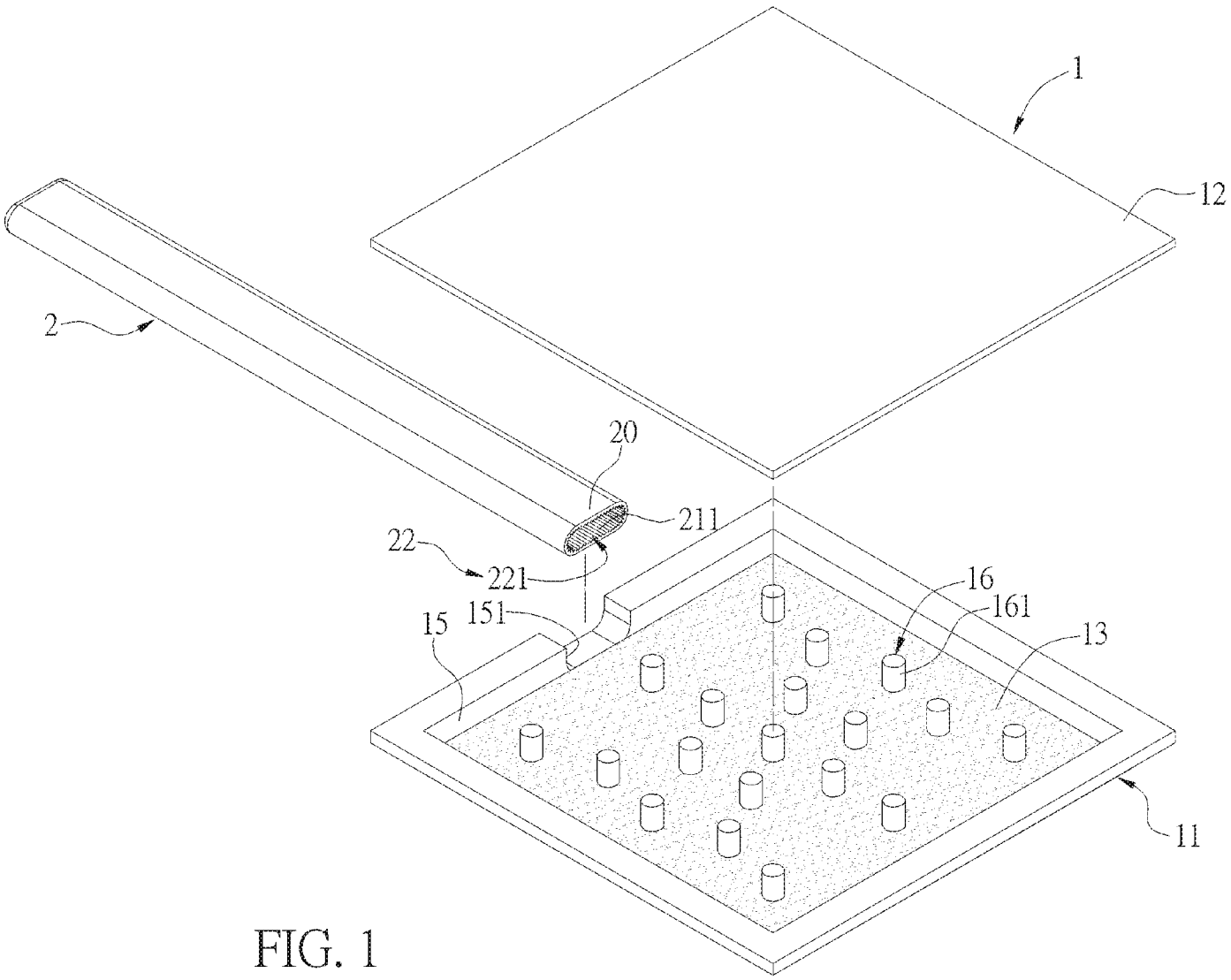
FIG. 1 is an exploded view illustrating an embodiment of a vapor chamber.

Furthermore, as shown in FIGS. 1 to 3, a first support structure 16 is disposed in the vapor chamber 1. A plurality of support pillars 161 is used for illustration purposes, wherein the support pillars 161 support the bottom board 11 (11*a*) and the cover board 12 (12*a*), so as to prevent the vapor chamber 1 from deforming when the vapor chamber 1 is vacuumized.

Moreover, a second support structure (not shown) may be disposed in the heat pipe 2, so that the second support structure can support the flat heat pipe 2 therein, so as to prevent the heat pipe 2 from breaking when the heat pipe 2 is flatted. Still further, the third capillary structure 3 may be formed with the first capillary structure 13 or the second capillary structure 21 integrally. For example, the third capillary structure 3 and the first capillary structure 13 (or the third capillary structure 3 and the second capillary structure 21) both may be formed by a powder sintering process or a ceramic sintering process integrally.

As mentioned in above, compared to the prior art, example embodiments provide numerous advantages. According to example embodiments, the second capillary structure 21 of the heat pipe 2 is connected and in communication with the first capillary structure 13 of the vapor chamber 1, so as to achieve holistic thermal conduction. Accordingly, the vapor chamber 1 incorporating the heat pipe 2 can fully provide the desired heat dissipation effect.

Further, by arranging the first, second and third capillary structures 13, 21, 3 side by side, example embodiments can be used in the thin vapor chamber 1 and the flat heat pipe 2. The open portion 22 is contributive to connect the third capillary structure 3. Especially, when the open portion 22 comprises the opening 221 and the breach 222, the mandible portion 23 can be formed, so that the third capillary structure 3 can be connected more conveniently and easily. By means of sinking the cover board 12, 12*a* to form the recess portion 1221, the filler 1211 extending from the inner surface of the cover board can be filled in the gap G between the heat pipe 2 and the vapor chamber 1, so that the heat pipe 2 is more suitable for the hole 151 of the vapor chamber 1. Accordingly, the heat pipe 2 can be welded to the vapor chamber 1 more easily. Since the communication neck 17 extends from the vapor chamber 1 integrally, the heat pipe 2 can be connected to the vapor chamber 1 securely. Using the first support structure 16 and the second support structure, the vapor chamber 1, according to example embodiments, is prevented from deforming when the vapor chamber 1 is vacuumized and the heat pipe 2 is prevented from breaking when the heat pipe 2 is flatted.

Figure 11:
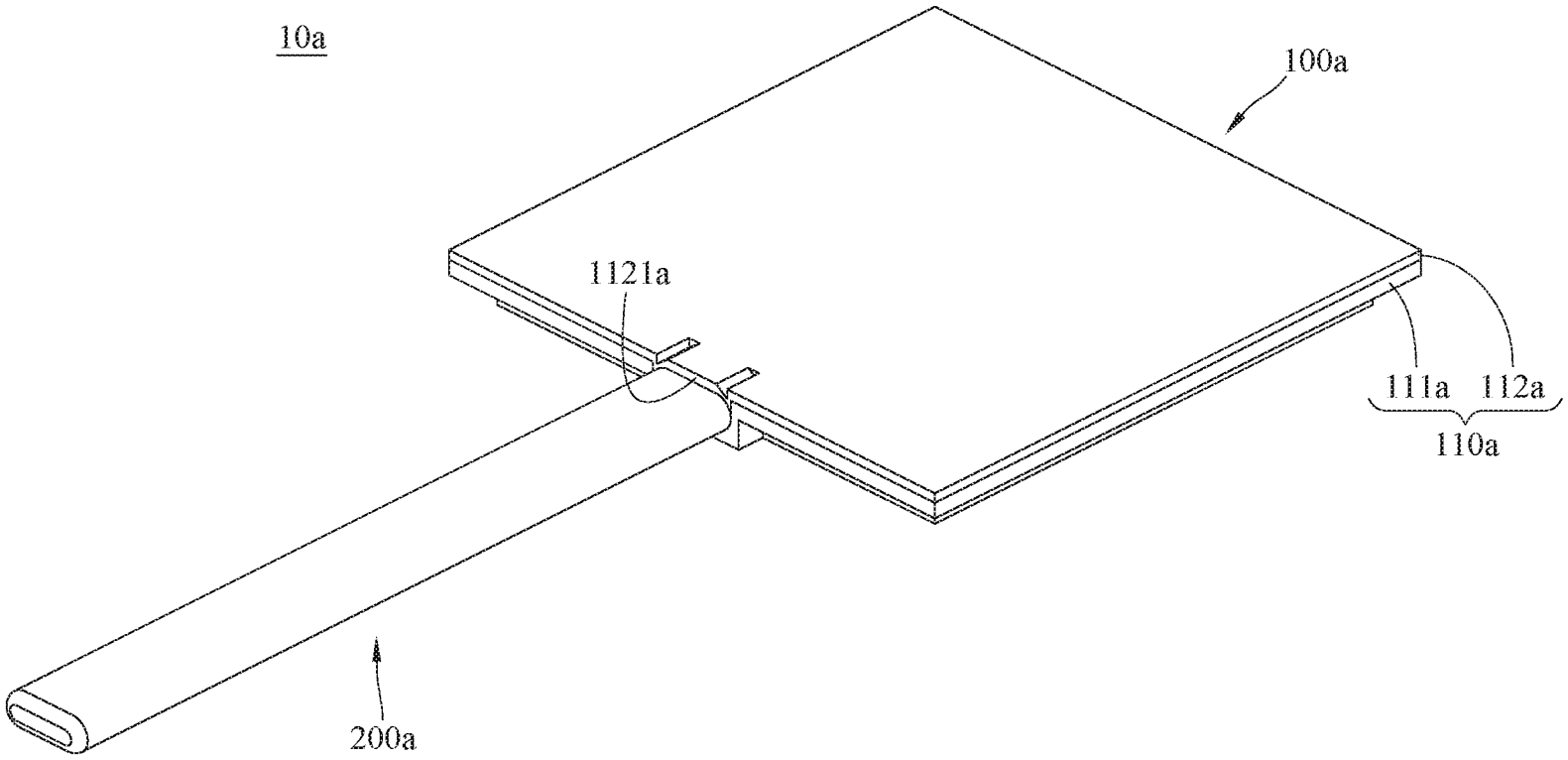
FIG. 11 is a perspective view of a heat dissipation device, according to example embodiments of the present disclosure.
Figure 12:
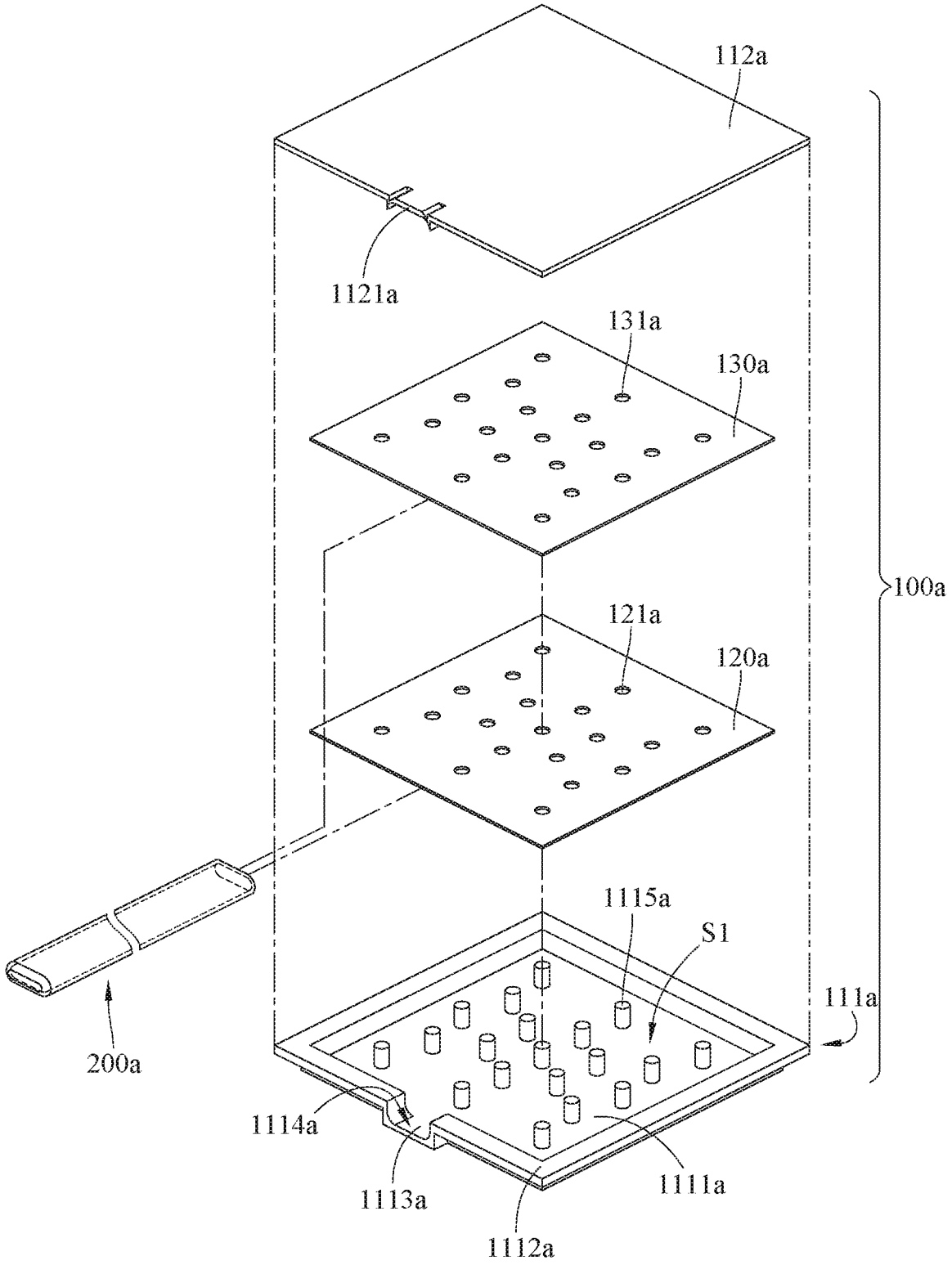
FIG. 12 is an exploded view of FIG. 11.
Figure 13:
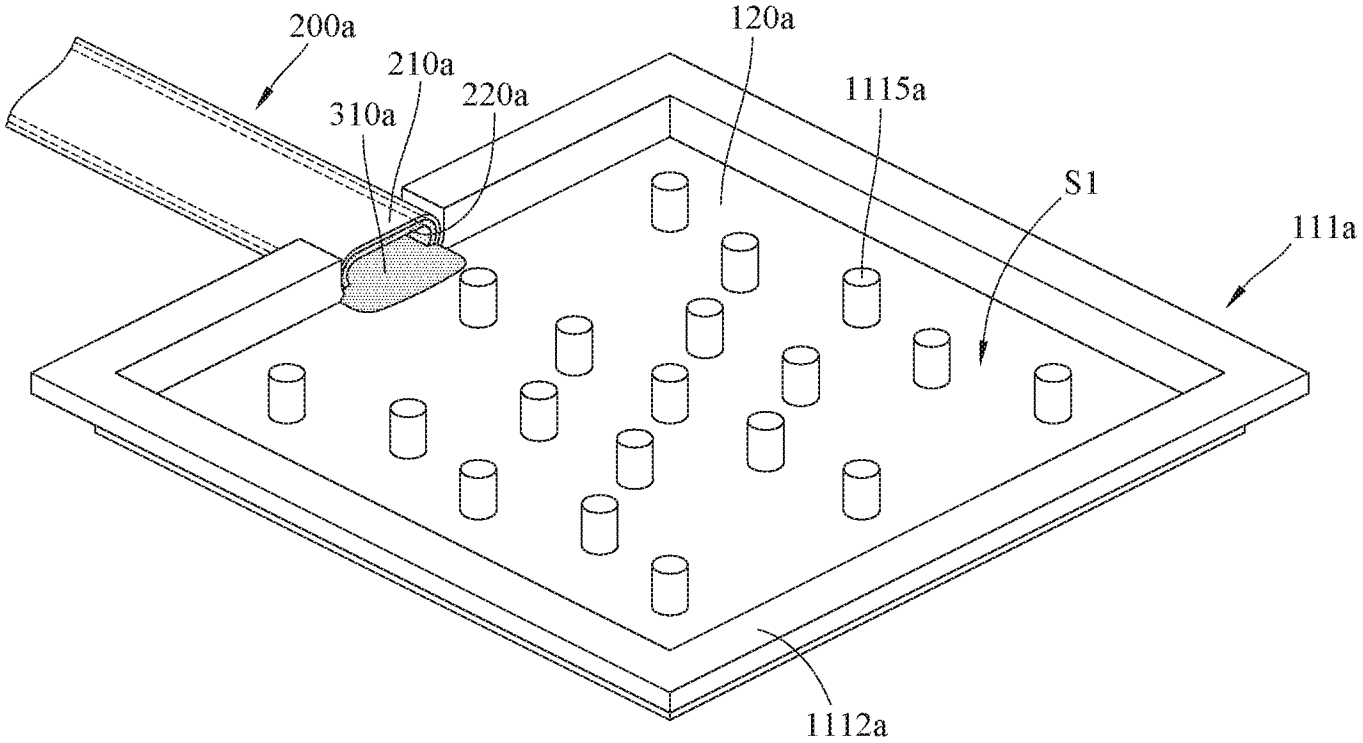
FIG. 13 is a perspective view of a base part, a first wick structure, a heat pipe and a bonding layer in FIG. 11.
Figure 14:
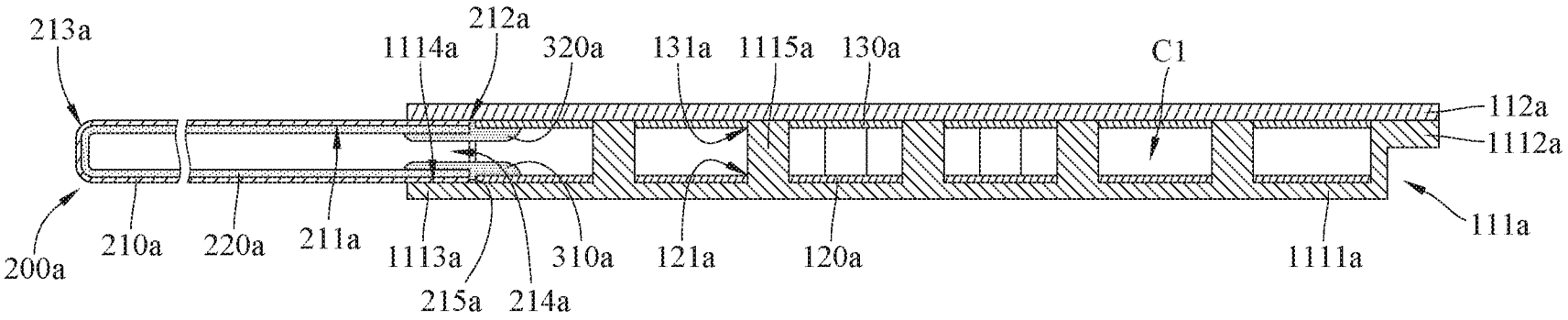
FIG. 14 is a cross-sectional view of FIG. 11.
Figure 15:
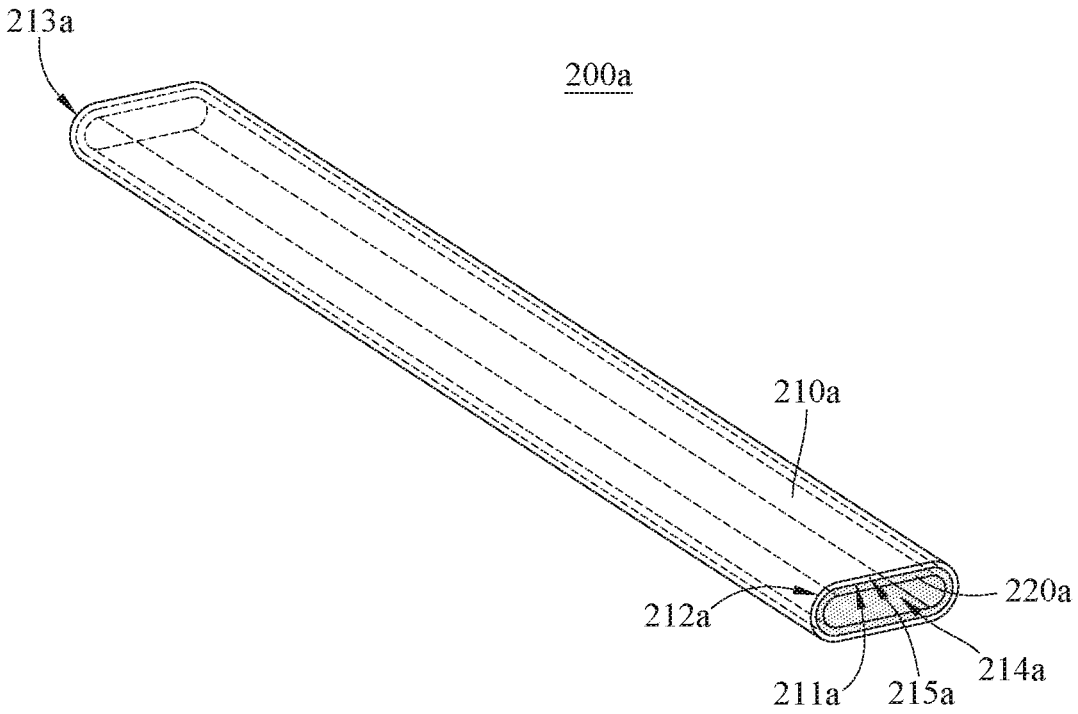
FIG. 15 is a perspective view of the heat pipe in FIG. 12.

FIG. 11 is a perspective view of a heat dissipation device, according to example embodiments of the present disclosure. FIG. 12 is an exploded view of FIG. 11. FIG. 13 is a perspective view of a base part, a first wick structure, a heat pipe and a bonding layer in FIG. 11 assembled together. FIG. 14 is a cross-sectional view of FIG. 11. FIG. 15 is a perspective view of the heat pipe in FIG. 12

According to example embodiments, a heat dissipation device 10*a* includes a vapor chamber 100*a* and a heat pipe 200*a*, and a working fluid (not shown in figures) flows through the vapor chamber 100*a* and the heat pipe 200*a*.

The vapor chamber 100*a* includes a heat conduction chamber 110*a*. The heat conduction chamber 110*a* includes a base part 111*a* and a cover part 112*a*. The base part 111*a* includes a base portion 1111*a*, a surrounding portion 1112*a*, and a recessed portion 1113*a* in the surrounding portion 1112*a*. The surrounding portion 1112*a* is disposed along the periphery of the base portion 1111*a*, and forms a rim of the base portion 1111*a*. The base portion 1111*a* and the surrounding portion 1112*a* cooperatively define a recessed space S1. The recessed portion 1113*a* may define an opening to the recessed space S1. The recessed portion 1113*a* defines a bearing surface 1114*a* and is sized and shaped (or otherwise configured) to receive the heat pipe 200*a*.

In an assembled state, the cover part 112*a* is disposed on and contacts the surrounding portion 1112*a* of the base part 111*a* so as to form a chamber C1 (FIG. 14) between the base part 111*a* and the cover part 112*a*. The chamber C1 is shaped and sized (or otherwise configured) to receive and accommodate the working fluid (not shown in figures) through the vapor chamber 100*a* and the heat pipe 200*a*. Although the base part 111*a* and the cover part 112*a* are disclosed as two individual pieces that are assembled together, example embodiments are not limited thereto. In other embodiments, the base part 111*a* and the cover part 112*a* may be made of a single piece.

A first wick structure 120*a* is included in the vapor chamber 100*a*, and is stacked on (and contacts) the base portion 1111*a* of the base part 111*a* and is between the base part 111*a* and the cover part 112*a*. The first wick structure 120*a* is or includes, for example, a ceramics sintered body, but the first wick structure 120*a* is not limited thereto. In other embodiments, the first wick structure 120*a* may be or include a micro slit, a metal mesh, a powder sintered body, a ceramics sintered body, combination thereof, and the like. For example, the first wick structure 120*a* may be a composite of ceramics powder sintered body and micro slit.

The vapor chamber 100*a* also includes a second wick structure 130*a*. The second wick structure 130*a* is stacked on (and contacts) the cover part 112*a* and is between the base part 111*a* and the cover part 112*a*. However, embodiments are not limited in this regard. In other embodiments, the second wick structure 130*a* may be omitted, and thus the vapor chamber 100*a* may only include the first wick structure 120*a*.

The cover part 112*a* defines a stamped portion 1121*a* corresponding to the recessed portion 1113*a* of the base part 111*a*. The stamped portion 1121*a* is shaped and sized (or otherwise configured) to fluidly couple the heat pipe 200*a* to the heat conduction chamber 110*a*, as illustrated in FIG. 13.

Referring to FIG. 15, the heat pipe 200*a* includes a pipe body 210*a* and a wick structure 220*a*. The pipe body 210*a* is a flat, tubular, elongated hollow pipe structure having a tubular inner surface 211*a*. The pipe body 210*a* has an open end 212*a* and a closed end 213*a* opposite to each other. The open end 212*a* of the pipe body 210*a* has an opening 214*a* and a side edge 215*a* which forms the opening 214*a*.

The wick structure 220*a* is annularly formed on and in contact with the tubular inner surface 211*a* of the pipe body 210*a*. The wick structure 220*a* extends between the open end 212*a* and the closed end 213*a*, and one end of the wick structure 220*a* contacts or is connected to the inner surface of the pipe body 210*a* at closed end 213*a*, and the other opposite end of the wick structure 220*a* is aligned (flush) with the side edge 215*a*. In an example, the length of the wick structure 220*a* is approximately the same as the length of the pipe body 210*a*.

The wick structure 220*a* includes, for example, a powder sintered body, but is not limited in this regard. In other embodiments, the wick structure 220*a* may be or include micro slits, metal mesh, powder sintered body, ceramics sintered body, a combination thereof, and the like. For example, the wick structure 220*a* may be a composite of powder sintered body and metal mesh.

The open end 212*a* of the heat pipe 200*a* is disposed in the recessed portion 1113*a* and contacts the bearing surface 1114*a* of the recessed portion 1113*a*, and the heat pipe 200*a* is clamped between the stamped portion 1121*a* and the recessed portion 1113*a*. The wick structure 220*a* is connected to (or linked to) the wick structures 120*a* and 130*a* via metallic bonding.

Referring to FIG. 14, the heat dissipation device 10*a* further includes two bonding layers 310*a* and 320*a*. The bonding layers 310*a* and 320*a* include Au, Ag, Cu or Fe powder. The bonding layers 310*a* and 320*a* are made into porous structures by sintering or other similar processes. As illustrated in FIG. 14, one end of the bonding layer 310*a* is connected to (or linked to) the wick structure 120*a* via metallic bonding, and the other opposite end of the bonding layer 310*a* is connected to (or linked to) the wick structure

220*a* via metallic bonding. Similarly, one end of the bonding layer 320*a* is connected to (or linked to) the wick structure 130*a* by metallic bonding, and the other opposite end of the bonding layer 320*a* is connected to (or linked to) the wick structure 220*a* via metallic bonding. In an embodiment and as illustrated, the wick structures 120*a* and 130*a* are axially separated (or spaced apart) from the wick structure 220*a*, and are connected (or otherwise coupled) to the wick structure 220*a* via the bonding layers 310*a* and 320*a* using metallic bonding. As illustrated in FIG. 14, the bonding layer 310*a* overlaps portions of the wick structure 120*a* and the wick structure 220*a* which are arranged adjacent each other (in parallel). Similarly, the bonding layer 320*a* overlaps portions of the wick structure 130*a* and the wick structure 220*a* which are arranged adjacent each other (in parallel). Such a configuration permits use of a vapor chamber 100*a* having a reduced vertical extent (e.g., with reference to FIG. 14) and a relatively flat heat pipe 200*a*. Although embodiments disclose metallic bonding between the wick structures 120*a*, 130*a* and wick structure 220*a*, other types of bonding can also be used without departing from the scope of the disclosure.

The base part 111*a* includes a plurality of supporting structures 1115*a* (e.g., FIGS. 12 and 13). Each of the supporting structures 1115*a* is, for example, a protrusion that extends vertically from the base portion 1111*a* of the base part 111*a*. The wick structure 120*a* includes a plurality of through holes 121*a*, and the wick structure 130*a* includes a plurality of through holes 131*a*. The through holes 121*a* and 131*a* correspond to the wick structures 120*a* and 130*a*. When the wick structures 120*a* and 130*a* are arranged in the chamber C1, and the supporting structures 1115*a* are respectively received in the through holes 121*a* and 131*a*. The supporting structures 1115*a* contact the cover part 112*a* and provide support to the cover part 112*a* to limit the vapor chamber 100*a* from deforming operation, for example, during a vacuuming process.

The wick structure 120*a* and the wick structure 220*a* are connected to each other via the bonding layer 310*a*. The working fluid flows between the wick structure 120*a* and the wick structure 220*a*, and the wick structure 120*a* and the wick structure 220*a* operate as a single unit to improve the flow of the working fluid from the wick structure 220*a* to the wick structure 120*a*. Similarly, the wick structure 130*a* and the wick structure 220*a* operate as a single unit to improve the flow of the working fluid from the wick structure 220*a* to the wick structure 130*a*. Thus, heat dissipation efficiency of the heat dissipation device 10*a* is improved.

In the embodiments illustrated in FIGS. 11-15, the heat dissipation device 10*a* includes a single heat pipe 200*a*. However, embodiments are not limited in this regard. In other embodiments, the heat dissipation device 10*a* may include more than one heat pipe 200*a* that are coupled to the vapor chamber 100*a* via a corresponding number of recessed portions 1113*a*.

Although the wick structure 220*a* of the heat pipe 200*a* is disclosed as being metallically bonded to the wick structures 120*a* and 130*a*, embodiments are not limited in this regard. In other embodiments, the wick structure 220*a* of the heat pipe 200*a* may be metallically bonded to either the wick structure 120*a* or the wick structure 130*a*, not both.

A method of manufacturing a heat dissipation device, includes providing a vapor chamber 100*a* having a first wick structure 120*a*, coupling a heat pipe 200*a* including a second wick structure 220 to the vapor chamber 100*a*, providing a metal powder to cover at least part of the first wick structure 120*a* and at least part of the second wick structure 220, and performing a sintering process to transform the metal powder into a bonding layer to metallically bond the first wick structure 120*a* and the second wick structure 220 to each other.

FIGS. 16-22 are perspective views of different configurations of heat pipes 200*b-h* according to example embodiments. The heat pipes 200*b-h* may be used in the heat dissipation device 10*a*, wherein the heat pipes 200*b-h* are coupled to the vapor chamber 100*a*.

Figure 16:
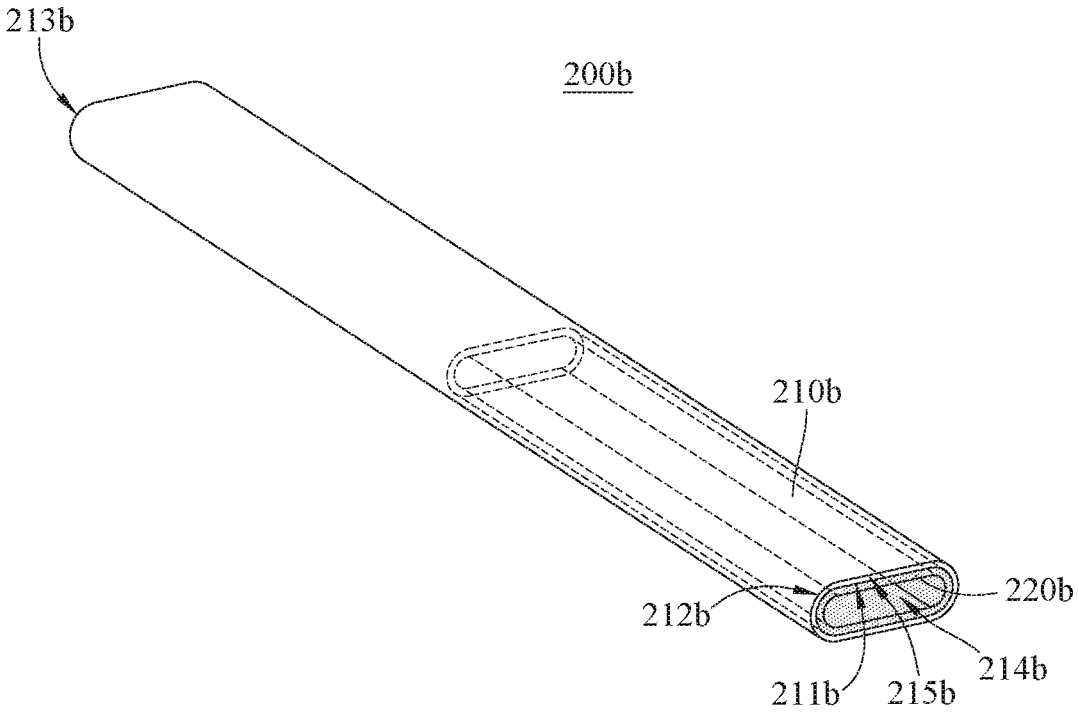
FIGS. 16-26 are perspective views of different configurations of heat pipes, according to example embodiments of the present disclosure.

As illustrated in FIG. 16, a heat pipe 200*b* includes a generally tubular pipe body 210*b* having a tubular inner surface 211*b*, an open end 212*b* and a closed end 213*b* axially opposite the open end 212*b*. A wick structure 220*b* is disposed annularly on and lines the tubular inner surface 211*b*. The open end 212*b* of the pipe body 210*b* has an opening 214*b* that is formed by a side edge 215*b* of the pipe body 210*b* at the open end 212*b*. As illustrated, the wick structure 220*b* does not contact the closed end 213*b* (or specifically, the inner surface of the pipe body 210*a* at the closed end 213*b*). One end of the wick structure 220*b* is spaced from the closed end 213*b*, and the opposite end of the wick structure 220*b* is aligned (or flush) with the side edge 215*b* of the pipe body 210*b*. In an embodiment, and as illustrated, the length (e.g., axial extent) of the wick structure 220*b* is half the length of the pipe body 210*b*. However, embodiments are not limited thereto. In other embodiments, the length of the wick structure 220*b* may be greater than or less than half the length of the pipe body 210*b*.

Figure 17:
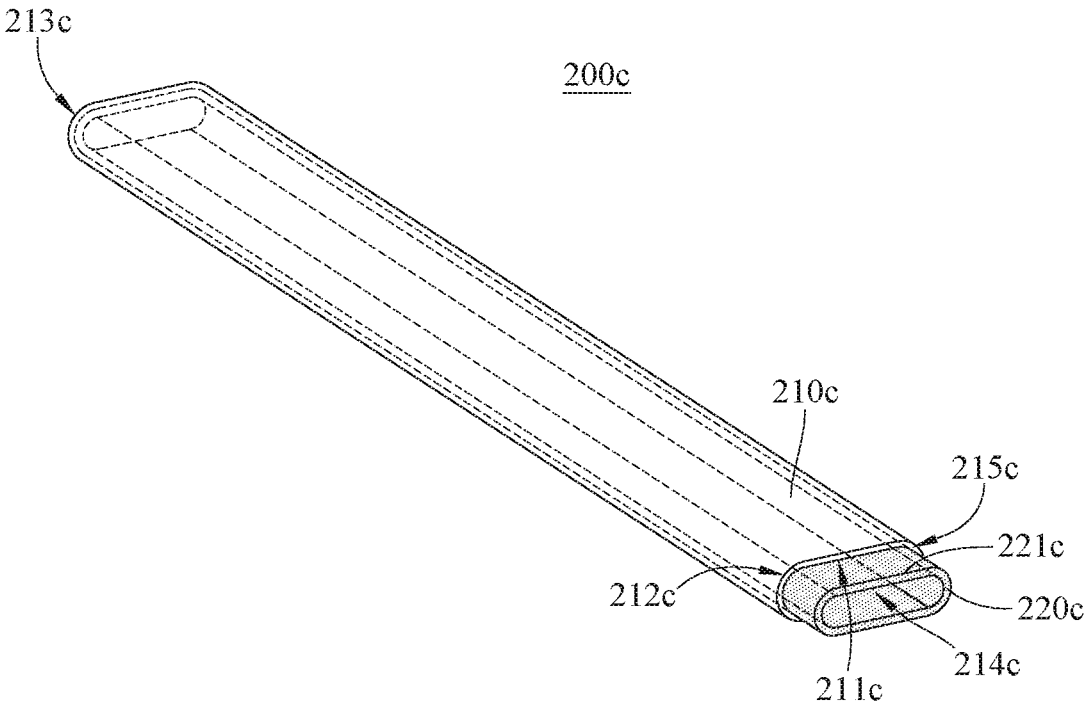

As illustrated in FIG. 17, a heat pipe 200*c* includes a generally tubular pipe body 210*c* having a tubular inner surface 211*c*, an open end 212*c* and a closed end 213*c* axially opposite the open end 212*c*. The open end 212*c* of the pipe body 210*c* has an opening 214*c* that is formed by a side edge 215*c* of the pipe body 210*c*. A wick structure 220*c* is disposed annularly on and lines the tubular inner surface 211*c* of the pipe body 210*c*. One end of the second wick structure 220*c* is connected to (or otherwise contacts) the inner surface of the pipe body 210*a* at the closed end 213*c*, and the other opposite end of the wick structure 220*c* protrudes a certain distance from the opening 214*c*. As illustrated, the wick structure 220*c* includes a protruding portion 221*c* that protrudes (or extends) from the side edge 215*c* of the pipe body 210*c*. Thus, as illustrated, the wick structure 220*c* has a length longer than the length of the pipe body 210*c*.

Figure 18:
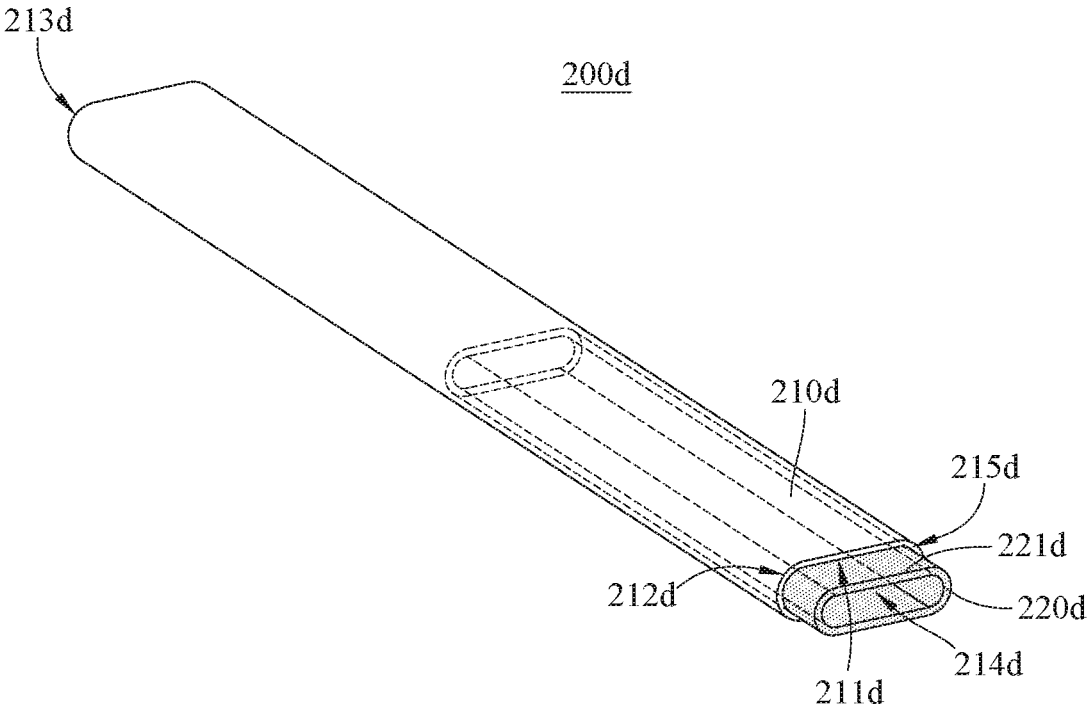

As illustrated in FIG. 18, a heat pipe 200*d* includes a generally tubular pipe body 210*d* having a tubular inner surface 211*d*, an open end 212*d* and a closed end 213*d* axially opposite to the open end 212*d*. The open end 212*d* of the pipe body 210*d* has an opening 214*d* that is formed by a side edge 215*d* of the pipe body 210*b*. A wick structure 220*d* is disposed annularly on and lines the tubular inner surface 211*d* of the pipe body 210*d*. One end of the wick structure 220*d* is axially spaced from the closed end 213*d* (more specifically, from the inner surface of the pipe body 210*a* at the closed end 213*d*), and the other opposite end of the wick structure 220*d* protrudes (or otherwise extends) a certain distance from the opening 214*d*. As illustrated, the wick structure 220*d* has a protruding portion 221*d* at a distal end thereof and that protrudes from the side edge 215*d* of the pipe body 210*d*. In an embodiment, the wick structure 220*d* may have a length greater than half the length of the pipe body 210*d*. However, embodiments are not limited thereto. In other embodiments, the wick structure 220*d* may have any desired length, while still protruding from the opening 214*d*.

Figure 19:
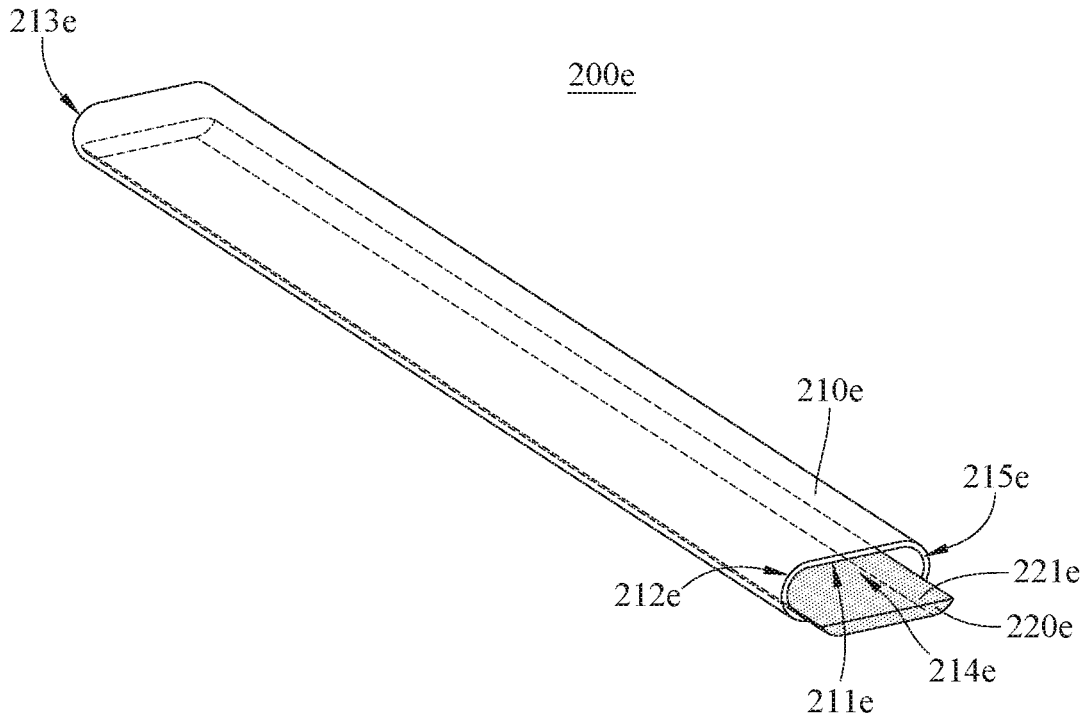

As illustrated in FIG. 19, a heat pipe 200*e* includes a generally tubular pipe body 210*e* having a tubular inner surface 211*e*, an open end 212*e* and a closed end 213*e* axially opposite to the open end 212*e*. The open end 212*e* of the pipe body 210*e* has an opening 214*e* that is formed by a side edge 215*e* of the pipe body 210*e*. A wick structure 220*e* is disposed only on a portion of the tubular inner surface 211*e*. In other words, the wick structure 220*e* does not line the entire tubular inner surface 211*e*. As illustrated, the wick structure 220*e* is disposed on the entire bottom portion of the tubular inner surface 211*e* and does not line the top portion of the tubular inner surface 211*e*. One end of the wick structure 220*e* contacts the closed end 213*e* (more specifically, from the inner surface of the pipe body 210*e* at the closed end 213*e*), and the other opposite end of the wick structure 220*e* protrudes (or otherwise extends) a certain distance from the opening 214*e*. As illustrated, the wick structure 220*e* has a protruding portion 221*e* at a distal end thereof that protrudes from the side edge 215*e* of the pipe body 210*e*. In an embodiment, the axial length of the wick structure 220*e* is longer than the axial length of the pipe body 210*e*.

Figure 20:
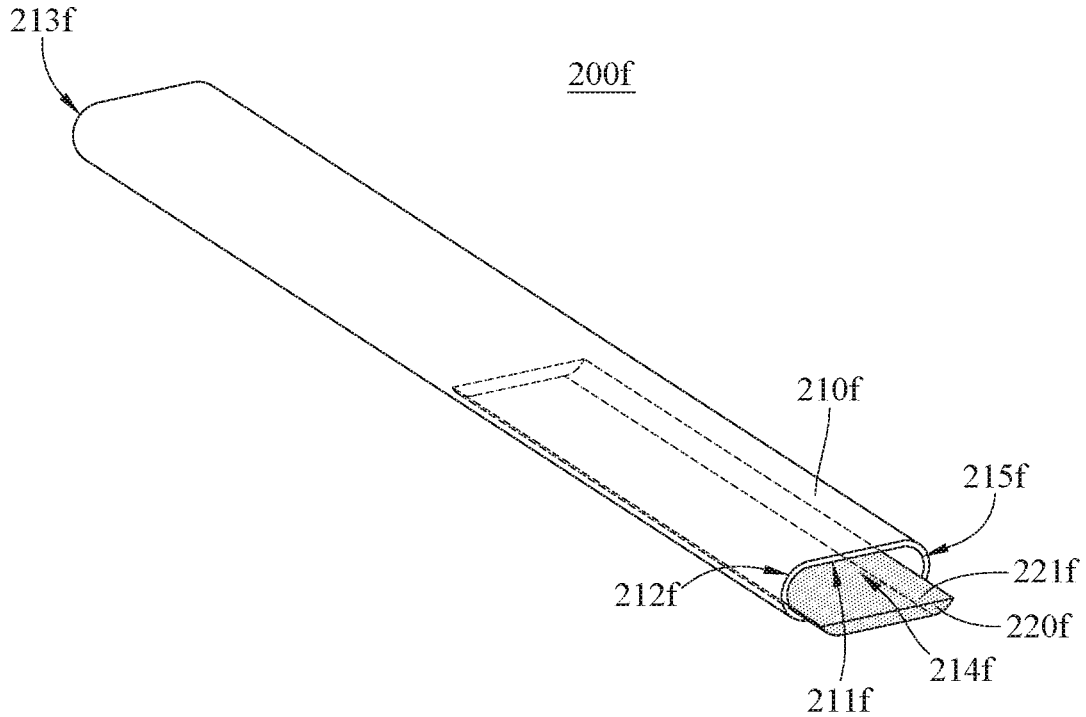

As illustrated in FIG. 20, a heat pipe 200*f* includes a generally tubular pipe body 210*f* having a tubular inner surface 211*f*, an open end 212*f* and a closed end 213*f* axially opposite to the open end 212*f*. The open end 212*f* of the pipe body 210*f* has an opening 214*f* that is formed by a side edge 215*f* of the pipe body 210*f*. A wick structure 220*f* is disposed on only a portion of the tubular inner surface 211*f*. Stated otherwise, the wick structure 220*f* does not line the entire tubular inner surface 211*f*. As illustrated, the wick structure 220*f* is disposed on only a portion of the tubular inner surface 211*f* at the bottom. One end of the wick structure 220*f* is axially spaced from the closed end 213*f* (more specifically, from the inner surface of the pipe body 210*f* at the closed end 213*f*), and the other opposite end of the second wick structure 220*f* protrudes (or otherwise extends) a certain distance from the opening 214*f*. As illustrated, the wick structure 220*f* has a protruding portion 221*f* at a distal end thereof that protrudes from the side edge 215*f* of the pipe body 210*f*. In an embodiment, the wick structure 220*f* may have a length greater than half the length of the pipe body 210*f*. However, embodiments are not limited thereto. In other embodiments, the wick structure 220*f* may be of any desired length, while still protruding from the opening 214*f*.

Figure 21:
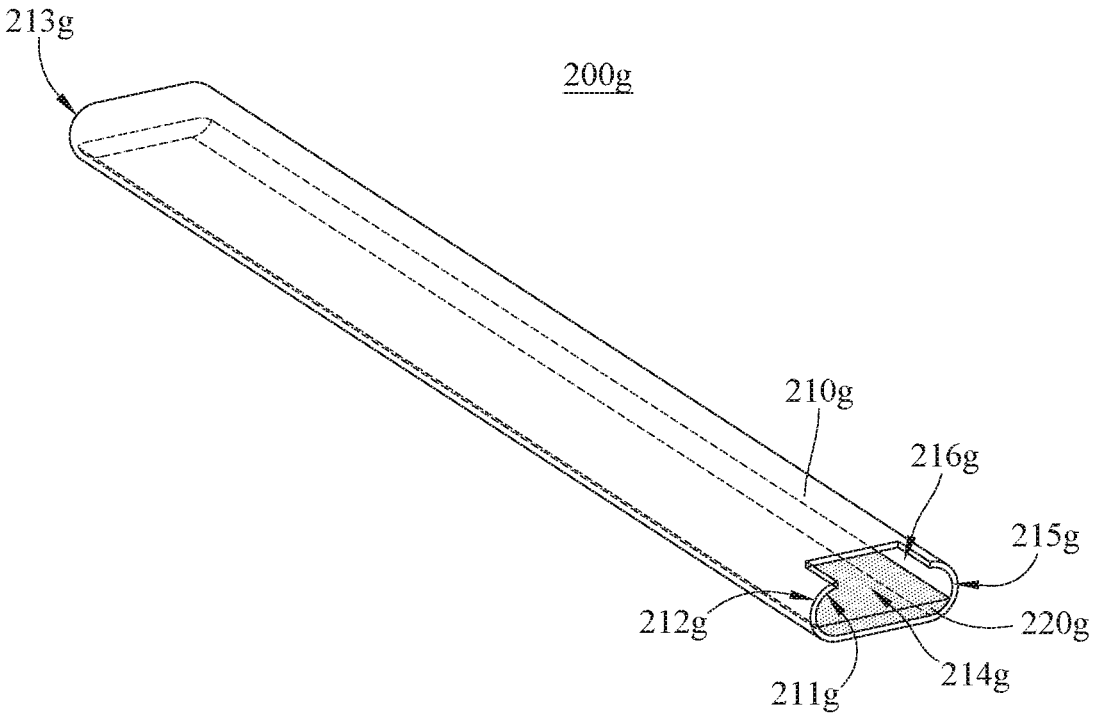

As illustrated in FIG. 21, a heat pipe 200*g* includes a generally tubular pipe body 210*g* having a tubular inner surface 211*g*, an open end 212*g* and a closed end 213*g* axially opposite to the open end 212*g*. The open end 212*g* of the pipe body 210*g* has an opening 214*g* that is formed by a side edge 215*g*. A wick structure 220*g* is disposed only on a portion of the tubular inner surface 211*g*. In other words, the wick structure 220*g* does not line the entire tubular inner surface 211*g*. As illustrated, the wick structure 220*g* is disposed on the entire bottom portion of the tubular inner surface 211*g* and does not line the top portion of the tubular inner surface 211*g*. One end of the wick structure 220*g* contacts the closed end 213*g* (more specifically, the inner surface of the pipe body 210*g* at the closed end 213*g*), and the other opposite end of the wick structure 220*g* is aligned or flush with the side edge 215*g*. A length of the wick structure 220*g* is approximately the same as the length of the pipe body 210*g*. In addition, the pipe body 210*g* includes a cut-off 216*g*. The cut-off 216*g* extends a certain distance axially (or longitudinally) along the pipe body 210*g* from the side edge 215*g* towards the closed end 213*g*. The cut-off 216*g* is indented on the side edge 215*g* and is fluidly coupled to the opening 214*g*. When the heat pipe 200*g* is coupled to the vapor chamber 100*a*, the wick structure 220*g* is metallically bonded to the wick structure 120*a* using the bonding layer 310*a* that is deposited on the wick structures 220*g* and 120*a*. The bonding layer 310*a* is formed by sintering metal powder. The cut-off 216*g* exposes the wick structures 220*g* and 120*a*, and this permits spreading the metal powder over wick structures 220*g* and 120*a* relatively easy. In an embodiment, the cut-off 216*g* may engage or couple to a protrusion of wick structures 120*a* and/or 130*a* (FIGS. 11-15).

Figure 22:
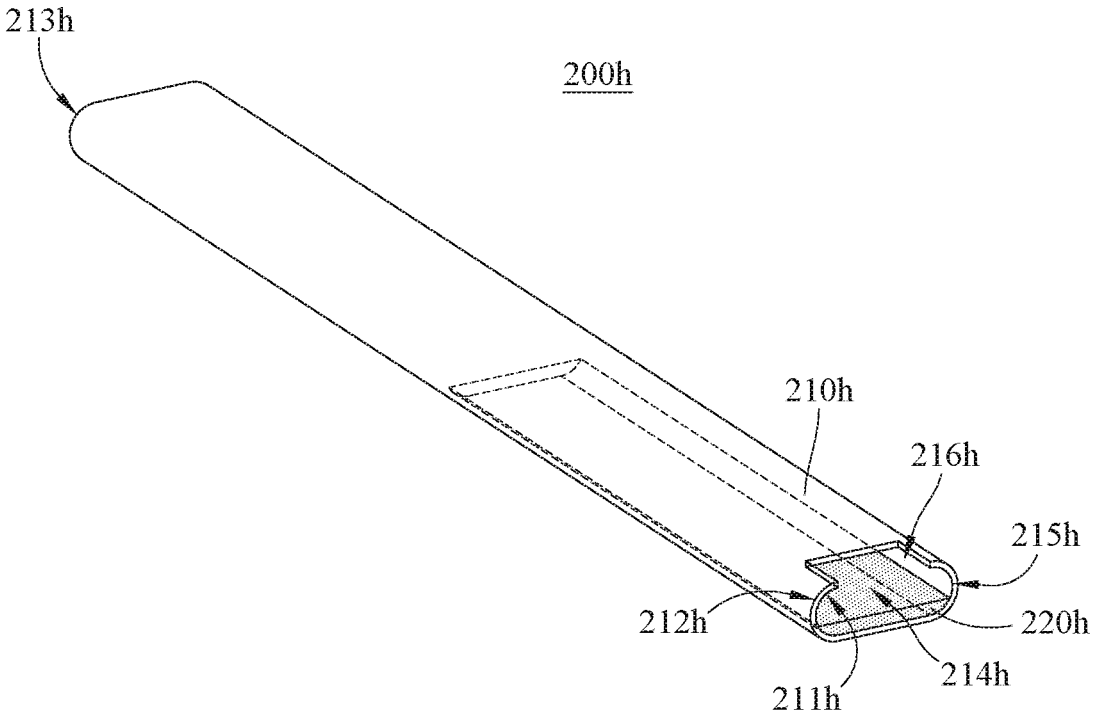

FIG. 22 illustrates a heat pipe 200*h* includes a generally tubular pipe body 210*h* having a tubular inner surface 211*h*, an open end 212*h* and a closed end 213*h* axially opposite to the open end 212*h*. The open end 212*h* of the pipe body 210*h* has an opening 214*h* that is formed by a side edge 215*h* of the pipe body 210*h*. A wick structure 220*h* is disposed only on a portion of the tubular inner surface 211*h*. Stated otherwise, the wick structure 220*h* does not line the entire tubular inner surface 211*h*. As illustrated, the wick structure 220*h* is disposed on only a portion of the tubular inner surface 211*h* at the bottom. One end of the wick structure 220*h* is axially spaced from the closed end 213*h* (more specifically, from the inner surface of the pipe body 210*h* at the closed end 213*h*), and the other opposite end of the wick structure 220*h* is aligned (flush) with the side edge 215*h*. In an embodiment, the axial length of the wick structure 220*h* is the same as half the axial length of the pipe body 210*h*. However, embodiments are not limited thereto. In other embodiments, the wick structure 220*h* may be greater than or less than half the length of the pipe body 210*h*. The pipe body 210*h* includes a cut-off 216*h* that extends a certain distance axially along the pipe body 210*h* from the side edge 215*h* towards the closed end 213*h*. The cut-off 216*h* is indented from the side edge 215*h* and fluidly coupled to the opening 214*h*. As discussed above, the cut-off 216*h* makes spreading the metal powder over wick structures 220*h* and 120*a* relatively easy.

As discussed above, the heat pipes 200*f*-200*h* in FIGS. 19 to 22 only contain one wick structure 220*f*-220*h*. However, embodiments are not limited thereto. In other embodiments, a heat pipe may have include another wick structure, for instance, disposed opposite the corresponding wick structure 220*f*-*h* and on the corresponding tubular inner surfaces 211*f*-*h*. The two wick structures may be bonded (e.g., metallically) to one of the wick structures 120*a* and 130*a* (FIGS. 1-5).

FIGS. 23-26 are perspective views of different configurations of heat pipes 200*i*, 200*j*, 200*k*, and 200*m*, according to example embodiments.

Figure 23:
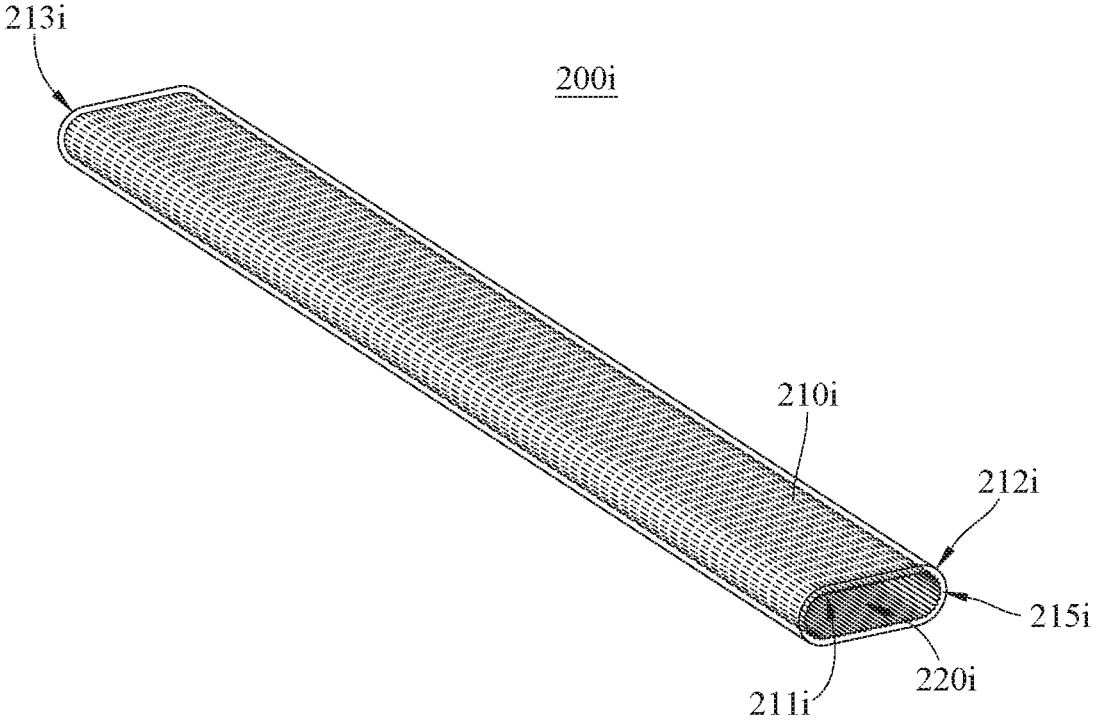

As shown in FIG. 23, a heat pipe 200*i* includes a generally tubular pipe body 210*i* having an open end 212*i* and a closed end 213*i* axially opposite to each other. The open end 212*i* of the pipe body 210*i* has a side edge 215*i*. A wick structure 220*i* is disposed along the tubular inner surface 211*i* of the pipe body 210*i* and includes, for example, micro slits. As illustrated, the wick structure 220*i* lines the tubular inner surface 211*i*. One end of the wick structure 220*i* contacts the closed end 213*i* (more specifically, the inner surface of the pipe body), and the other opposite end of the wick structure 220*i* is aligned (flush) with the side edge 215*i* of the pipe body 210*i*. In an embodiment, the length of the wick structure 220*i* is equal to the axial length of the pipe body 210*i*.

Figure 24:
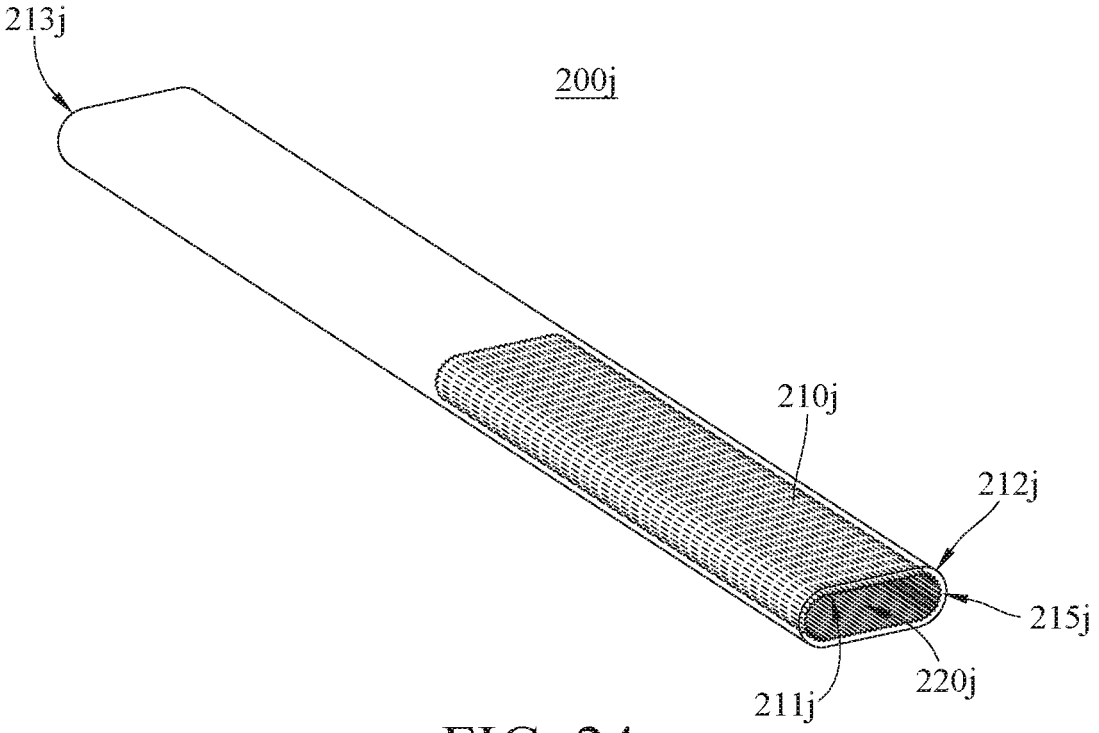

As illustrated in FIG. 24, a heat pipe 200*j* includes a generally tubular pipe body 210*j* having an open end 212*j* and a closed end 213*j* axially opposite each other. The open end 212*j* of the pipe body 210*j* has a side edge 215*j*. A second wick structure 220*j* is disposed along and lines the tubular inner surface 211*j* of the pipe body 210*j* and includes, for example, micro slits. One end of the wick structure 220*j* is axially spaced from the closed end 213*j*, and the other opposite end of the second wick structure 220*j* is aligned (flush) with the side edge 215*j* of the pipe body 210*j*. In an embodiment, the axial length of the wick structure 220*j* is approximately half the length of the pipe body 210*j*. However, embodiments are not limited thereto. In other embodiments, the axial length of the wick structure 220*j* may be greater than or less than half the length of the pipe body 210*j*.

Figure 25:
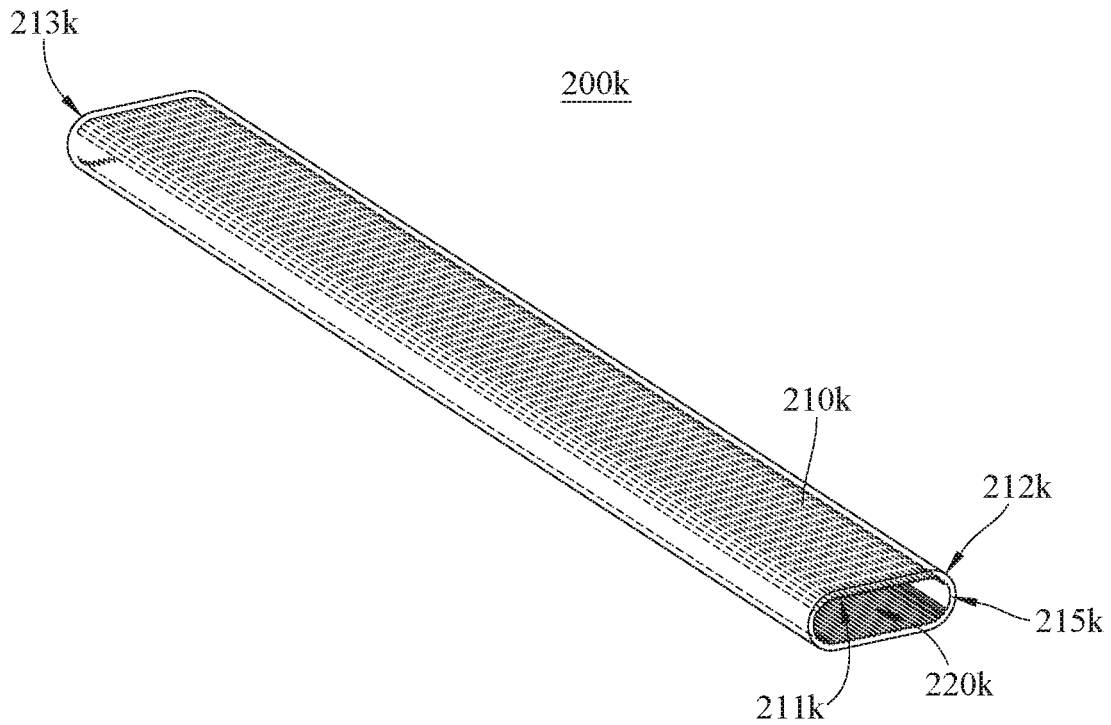

As illustrated in FIG. 25, a heat pipe 200*k* includes a pipe body 210*k* having an open end 212*k* and a closed end 213*k* axially opposite each other. The open end 212*k* of the pipe body 210*k* has a side edge 215*k*. Two wick structures 220*k* are disposed in the pipe body 210*k* and are vertically separated from each other. As illustrated, the wick structures 220*k* are disposed vertically opposite each other and line the tubular inner surface 211*k* of the pipe body 210*k*. The wick structures 220*k* include, for example, micro slits. One axial end of each wick structure 220*k* is connected to the closed end 213*k* (more specifically, the inner surface of the pipe body), and the other axially opposite side is aligned (flush) with the side edge 215*k* of the pipe body 210*k*. In an embodiment, the length of each wick structure 220*k* is approximately the same as the length of the pipe body 210*k*.

Figure 26:
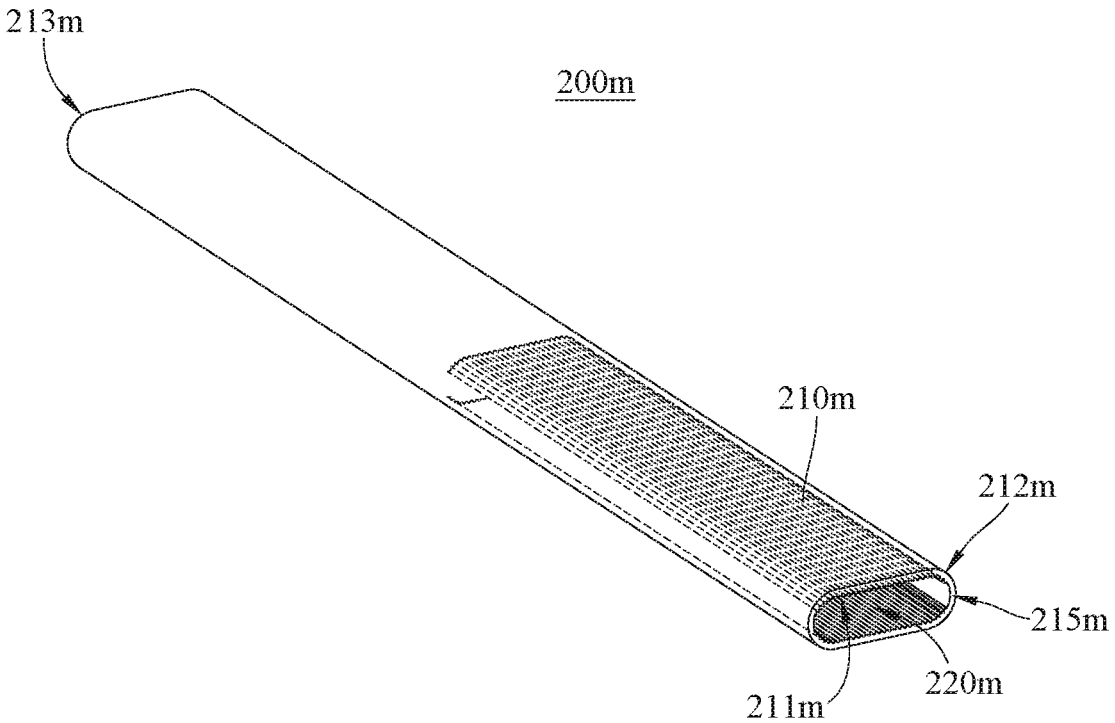

As illustrated in FIG. 26, a heat pipe 200*m* includes a pipe body 210*m* having an open end 212*m* and a closed end 213*m*. The open end 212*m* of the pipe body 210*m* has a side edge 215*m*. Two wick structures 220*m* are disposed in the pipe body 210*m* and are vertically separated from each other. As illustrated, the wick structures 220*m* are disposed vertically opposite each other and line the tubular inner surface 211*m* of the pipe body 210*m*. However, in an embodiment, and as illustrated, the wick structures 220*m* do not line the entire axial extent of the tubular inner surface 211*m*. The wick structures 220*m* include, for example, micro slits. One axial end of each wick structure 220*m* is axially spaced from the closed end 213*m*, and the other axially opposite end is aligned (flush) with the side edge 215*m* of the pipe body 210*m*. In an embodiment, the length of each wick structure 220*m* is approximately half the length of the pipe body 210*m*. However, embodiments are not limited in this regard, and the each wick structure 220*m* may have a length greater than or less than half the length of the pipe body 210*m*. In some other embodiments, each wick structure 220*m* may have different lengths.

The wick structures 220*m* include metal mesh, powder sintered body, ceramics sintered body, micro slits, combination thereof, and the like. However, the wick structures 220*m* are not limited in this regard.

Figure 27:
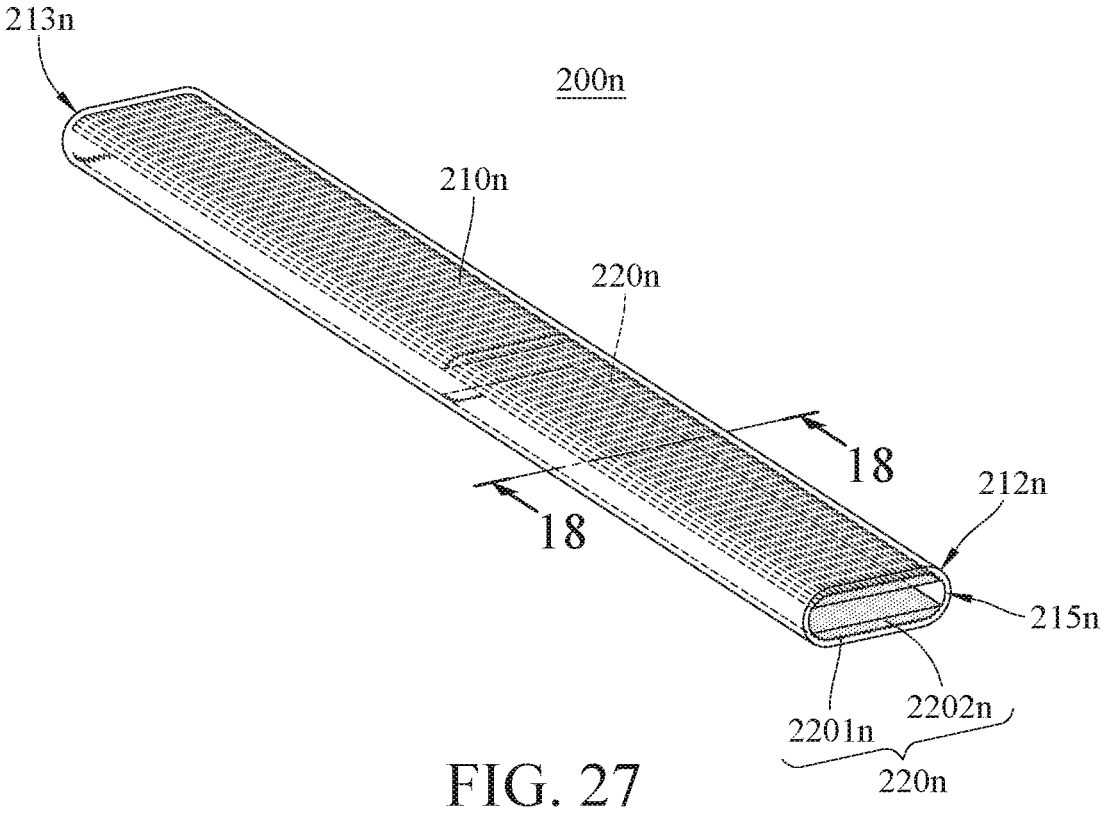
FIG. 27 is a perspective view of another heat pipe, according to example embodiments.
Figure 28:
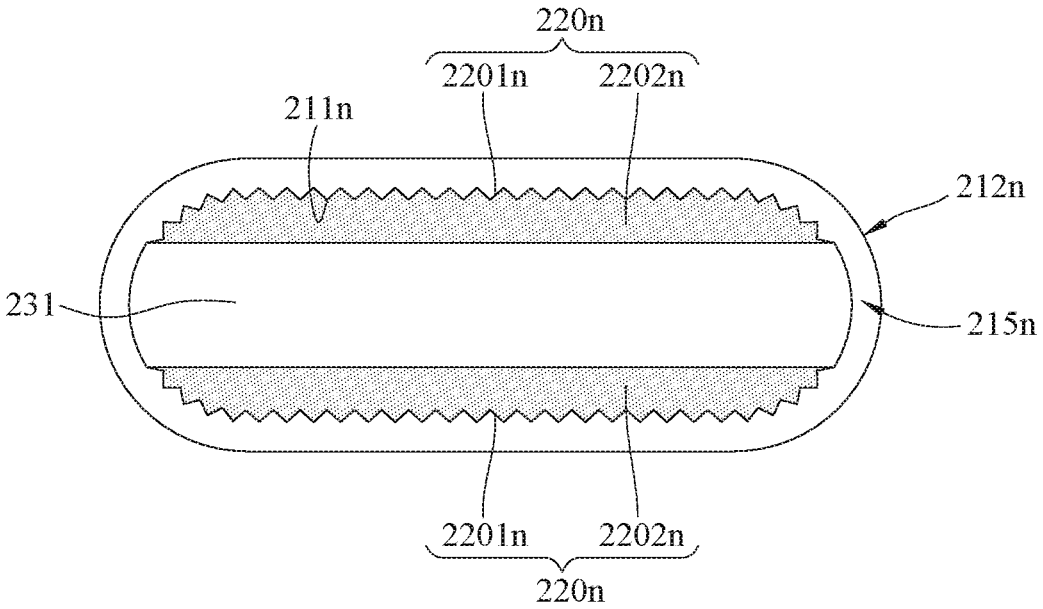
FIG. 28 is a cross-sectional view of the heat pipe of FIG. 27.

FIG. 27 is a perspective view of a heat pipe 200*n* according to example embodiments, and FIG. 28 is a cross-sectional view of the heat pipe 200*n* taken along the 18-18 plane.

The heat pipe 200*n* includes a pipe body 210*n* having an open end 212*n* and a closed end 213*n* axially opposite each other. The open end 212*n* of the pipe body 210*n* has a side edge 215*n*. Two wick structures 220*n* are disposed in the pipe body 210*n*.

As illustrated, the wick structures 220*n* are composite wick structures. Each wick structure 220*n* includes a first layer 2201*n* and a second layer 2202*n*. The first layer 2201*n* is disposed on and contacts (e.g., lines) an inner surface 211*n* of the pipe body 210*n*. The inner surface 211*n* is an uneven (e.g., jagged or toothed) surface that may be formed using known methods like etching or button rifling. The first layer 2201*n* is correspondingly uneven. The second layer 2202*n* is exposed to the interior of the heat pipe 200*n* and defines an internal passageway 231 of the heat pipe 200*n*. The first layer 2201*n* includes, for example, micro slits. The second layer 2202*n* includes, for example, metal mesh, sintered metal powder, a molecular polymer, a combination thereof and the like. One end of the wick structure 220*n* contacts the closed end 213*n*, and the other axially opposite end of the wick structure 220*n* is aligned (flush) with the side edge 215*n*. In another embodiment, one end of the wick structure 220*n* is axially spaced from the closed end 213*n*, and the other axially opposite end is aligned (flush) with the side edge 215*n*. However, the present disclosure is not limited thereto. In another embodiment, one end of the wick structure 220*n* may be connected to the closed end, and the axially opposite end may be aligned with the side edge of the pipe body.

Figure 29:
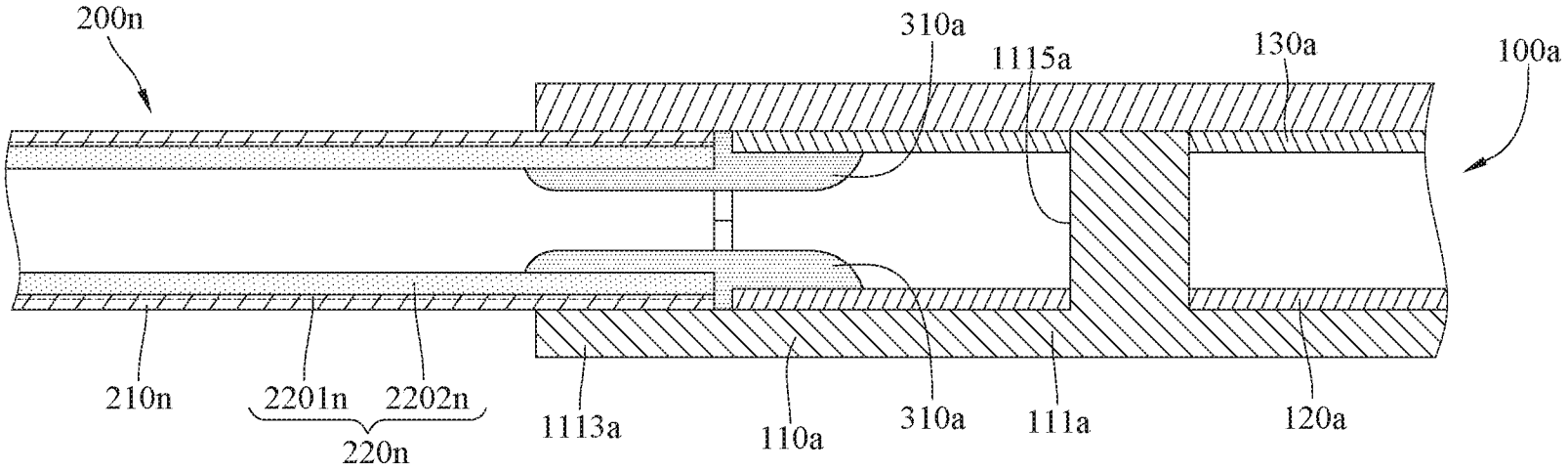
FIG. 29 illustrates a cross-sectional view of an assembly including the heat pipe of FIG. 27 coupled to a vapor chamber.

FIG. 29 illustrates a cross-sectional view of an assembly including the heat pipe 200*n* coupled to a vapor chamber. The vapor chamber may be the vapor chamber 100*a* in FIGS. 11-15.

The heat pipe 200*n* is disposed in the recessed portion 1113*a* of the base part 111*a*. The wick structure 220*n* is bonded (e.g., metallically) to the wick structures 120*a* via the second layer 2202*n* using bonding layers 310*a*. Similarly, the wick structure 220*n* is bonded (e.g., metallically) to the wick structures 130*a* via the second layer 2202*n* using bonding layers 310*a*.

Figure 30:
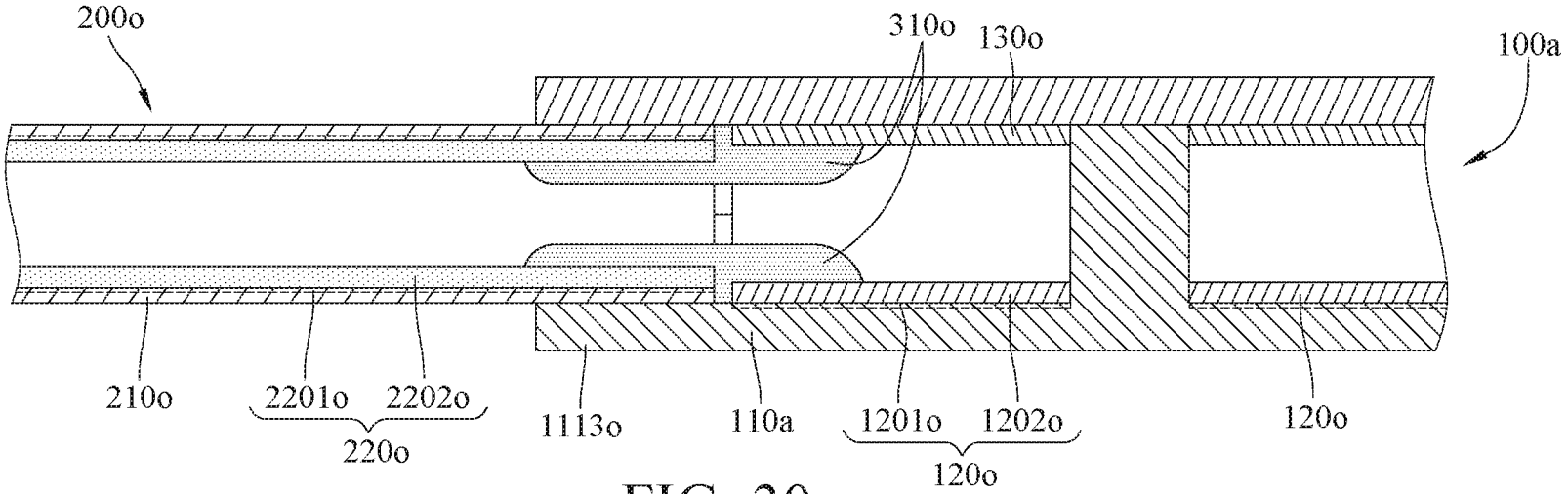
FIG. 30 is a cross-sectional view of an assembly including a heat pipe coupled to a vapor chamber, according to example embodiments.

FIG. 30 is a cross-sectional view of an assembly including a heat pipe 200*o* coupled to a vapor chamber, according to example embodiments. The vapor chamber may be the vapor chamber 100*a* in FIGS. 11-15. The vapor chamber 100*a* includes wick structure 120*o* which is also a composite wick structure (e.g., similar to the wick structure 220*n*). In detail, wick structure 120*o* includes a first layer 12010 and a second layer 1202*o*. The wick structure 130*a* has a similar structure. The first layer 12010 is disposed on and contacts (or lines) the inner side of the base part 111*a*, and the second layer 1202*o* defines the space S1 of the vapor chamber 100*a*. The first layer 12010 includes, for example, micro slits or metal mesh, and the second layer 1202*n* includes, for example, metal mesh, powder sintered body, ceramics sintered body. The pipe body 210*o* of the heat pipe 200*o* is disposed in the recessed portion 1113*a* of the base part 111*a*, The second layer 2202*o* of the wick structures 220*o* is metallically bonded to the second layer 1202*o* of the wick structure 120*o* via bonding layers 310*o*. Similarly, the second layer 2202*o* of the wick structures 220*o* is metallically bonded to the second layer 1202*o* of the wick structure 130*o* via bonding layers 310*o*.

Figure 31:
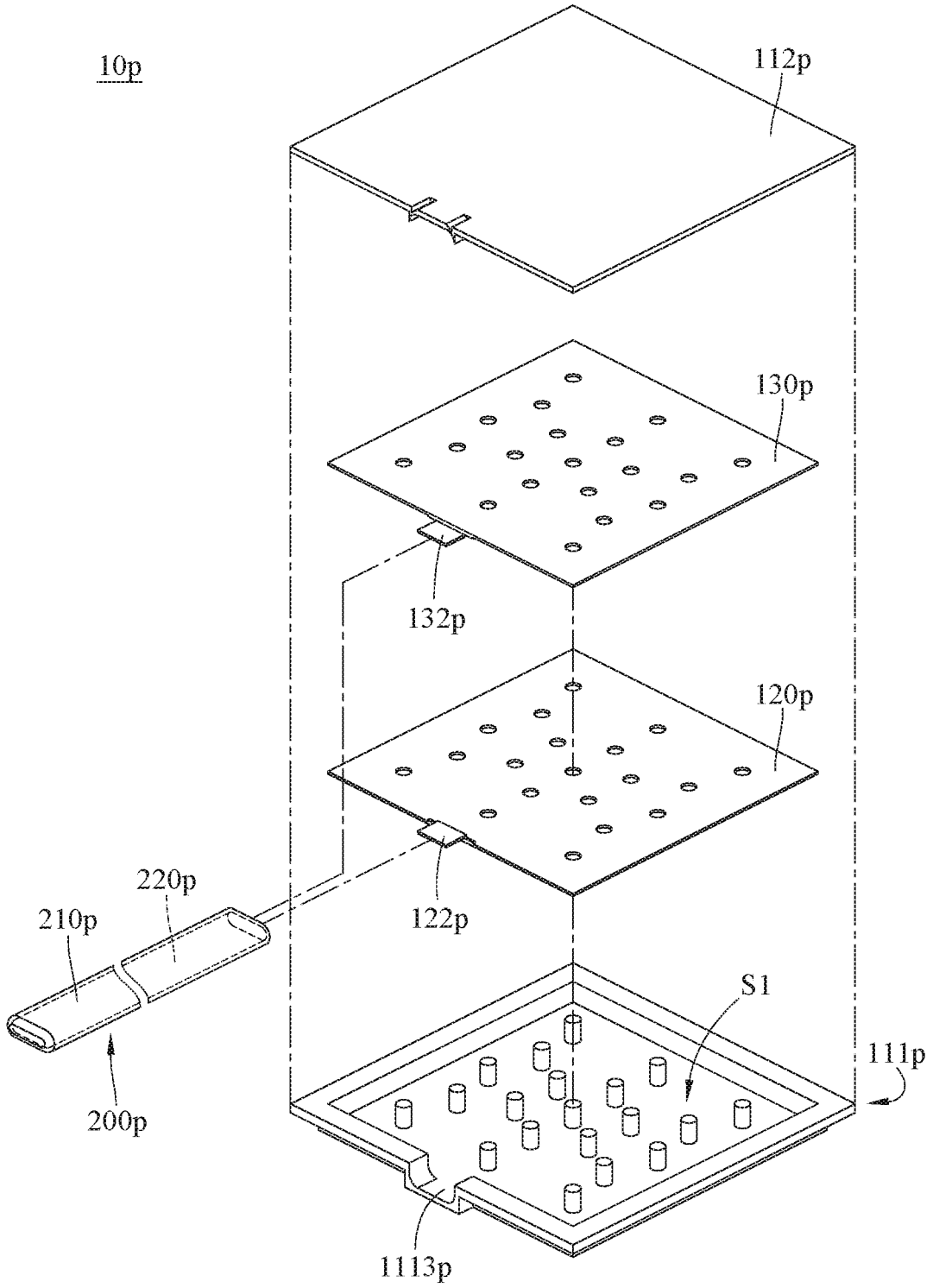
FIG. 31 is an exploded view of a heat dissipation device, according to an example embodiment of the present disclosure.
Figure 32:
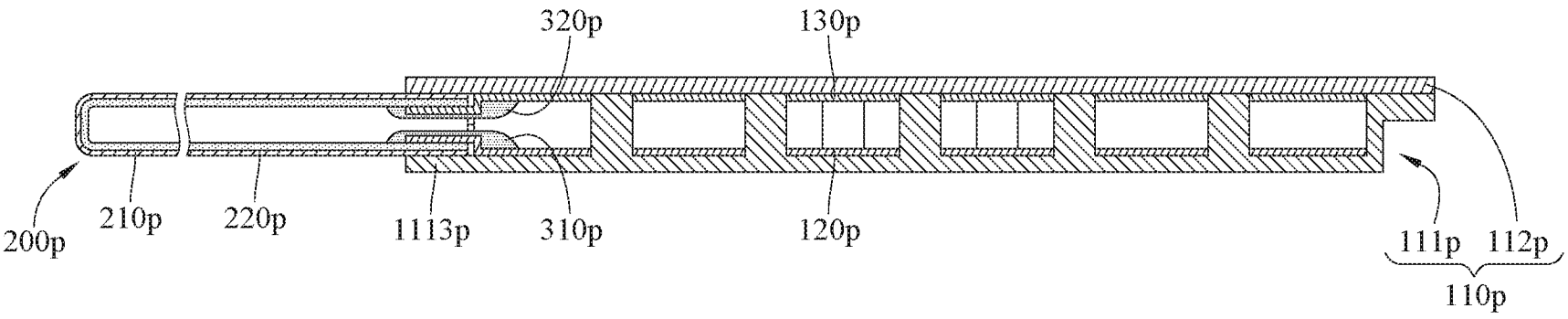
FIG. 32 is a cross-sectional view of the heat dissipation device in FIG. 31.

FIG. 31 is an exploded view of a heat dissipation device 10*p* according to an example embodiment of the present disclosure, and FIG. 32 is a cross-sectional view of the heat dissipation device 10*p* in FIG. 31 when assembled.

The heat dissipation device 10*p* may be similar in certain aspects to the heat dissipation device 10*a*. The heat dissipation device 10*p* includes a heat conduction chamber including a base part 111*p* and a cover part 112*p*. The base part 111*p* includes a recessed portion 1113*p*.

A wick structure 120*p* is disposed in the base part 111*p* and a wick structure 130*p* is disposed in the cover part 112*p* opposite the base part 111*p*. The wick structures 120*p* and 130*p* each include a respective protrusion 122*p* and 132*p*.

The heat dissipation device 10*p* includes a heat pipe 200*p* having a pipe body 210*p* and a wick structure 220*p*. The wick structure 220*p* is disposed on and lines the tubular inner surface of the pipe body 210*p*. The protrusions 122*p* and 132*p* are received in the pipe body 210*p* and coupled to the second wick structure 220*p*. For instance, the heat pipe 200*p* may include a cut-out (similar to the cut-outs 216*g* and 216*h* in FIGS. 21 and 22) and the protrusions 122*p* and 132*p* are each received in the cut-out.

The heat dissipation device 10*p* further includes two bonding layers 310*p* and 320*p*. The bonding layers 310*p* and 320*p* include Au, Ag, Cu or Fe powder. The bonding layers 310*p* and 320*p* are made into porous structures by sintering or other processes. The bonding layer 310*p* couples the wick structure 120*p* and the wick structure 220*p* to each other via metallic bonding. Similarly, the bonding layer 320*p* couples the wick structure 130*p* and the wick structure 220*p* via metallic bonding.

In other embodiments, the wick structures 120*p* and 130*p* may not have a protrusion, and the wick structure 220*p* may include a protrusion that protrudes from a side edge of the open end of the pipe body and is coupled to the wick structure 120*p* and/or 130*p*.

A method of manufacturing a heat dissipation device includes providing a vapor chamber having a first wick structure, coupling a heat pipe including a second wick structure to the vapor chamber, providing a metal powder to cover at least part of the first wick structure and at least part of the second wick structure, and performing a sintering process to transform the metal powder into a porous structure to connect the first wick structure and the second wick structure to each other. The bonding between the first wick structure and the second wick structure improves the flow of working fluid through the first wick structure and the second wick structure and thereby improves the heat dissipation efficiency of the heat dissipating device at the desired level.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A heat dissipation device, comprising:

a vapor chamber including a heat conduction chamber and a first wick structure, wherein the heat conduction chamber includes a base part, the base part includes a base portion and a surrounding portion, base portion and the surrounding portion cooperatively define a recessed space, the surrounding portion includes a recessed portion, the surrounding portion is connected to and disposed along a periphery of the base portion, the first wick structure is disposed in the heat conduction chamber and directly contacts the base portion; and a heat pipe including a pipe body and a second wick structure disposed in the pipe body, wherein the pipe body is a tubular structure that is flattened at diametrically opposite sides thereof, and includes two longitudinally opposite sides that are flattened and that are connected to each other by two laterally opposite curved sides, the pipe body is positioned in the recessed portion of the heat conduction chamber and an opening of the pipe body is flush with a surface of the surrounding portion that faces the recessed space and the pipe body does not protrude into the recessed space, the second wick structure is disposed on one or both longitudinally opposite sides of the pipe body, when disposed on one longitudinal side, the second wick structure is disposed only on one longitudinal side, when disposed on both longitudinal sides, two portions forming the second wick structure are separated from each other, and the first wick structure and the second wick structure are metallically bonded.

2. The heat dissipation device according to claim 1, further comprising a bonding layer, the bonding layer metallically bonding the first wick structure and the second wick structure.

3. The heat dissipation device according to claim 2, wherein the bonding layer includes Au, Ag, Cu or Fe powder.

4. The heat dissipation device according to claim 2, wherein the first wick structure includes a protrusion, and the protrusion is located in the pipe body and is coupled to the second wick structure.

5. The heat dissipation device according to claim 2, wherein the first wick structure is selected from a group consisting of micro slits, metal mesh, powder sintered body and ceramics sintered body.

6. The heat dissipation device according to claim 5, wherein the second wick structure is selected from a group consisting of metal mesh, powder sintered body and ceramics sintered body.

7. The heat dissipation device according to claim 2, wherein the pipe body includes an open end and an axially opposite closed end, wherein the open end of the pipe body has the opening and a side edge which defines the opening, and an end of the second wick structure is flush with the side edge.

8. The heat dissipation device according to claim 7, wherein the pipe body includes a cut-off indented in the pipe body and extending axially from the side edge towards the closed end and is fluidly coupled to the opening.

9. The heat dissipation device according to claim 7, wherein the second wick structure contacts the closed end.

10. The heat dissipation device according to claim 7, wherein the second wick structure is axially spaced from the closed end.

11. The heat dissipation device according to claim 2, wherein the pipe body has two longitudinally extending inner surfaces, and the second wick structure is disposed on one or both longitudinally extending inner surfaces.

12. The heat dissipation device according to claim 2, wherein the pipe body includes an open end and an axially opposite closed end, the open end including a side edge that forms the opening of the pipe body, wherein the second wick structure includes a protruding portion which protrudes from the side edge of the pipe body.

13. The heat dissipation device according to claim 12, wherein the second wick structure contacts the closed end.

14. The heat dissipation device according to claim 12, wherein the second wick structure is axially spaced from the closed end.

15. The heat dissipation device according to claim 12, wherein the pipe body has a tubular inner surface, the second wick structure is disposed on the tubular inner surface.

16. The heat dissipation device according to claim 5, wherein the second wick structure is selected from a group consisting of metal mesh, powder sintered body and ceramics sintered body and micro slits.

17. The heat dissipation device according to claim 16, wherein the pipe body includes an open end and an axially opposite closed end, the open end has the opening and a side edge which forms the opening, and the second wick structure is flush with the side edge.

18. The heat dissipation device according to claim 17, wherein the pipe body includes a cut-off indented in the pipe body and extending axially from the side edge towards the closed end and is fluidly coupled to the opening.

19. The heat dissipation device according to claim 17, wherein the pipe body has the closed end which is opposite to the open end, and the second wick structure is connected to the closed end.

20. The heat dissipation device according to claim 17, wherein the pipe body has the closed end which is opposite to the open end, and the second wick structure is separated from the closed end.

21. The heat dissipation device according to claim 19, wherein the pipe body has a tubular inner surface, the second wick structure is formed on the tubular inner surface.

22. The heat dissipation device according to claim 20, wherein the pipe body has a tubular inner surface, the second wick structure is formed on the tubular inner surface.

23. The heat dissipation device according to claim 1, wherein the heat conduction chamber further includes a cover part, and the cover part is disposed on the surrounding portion and the cover part and the base part cooperatively form a chamber therebetween.

24. The heat dissipation device according to claim 23, wherein the cover part includes a stamped portion, and the heat pipe is coupled between the stamped portion and the recess portion.

25. The heat dissipation device according to claim 23, wherein the first wick structure faces the cover part.

26. The heat dissipation device according to claim 23, further comprising a third wick structure, the first wick structure faces the cover part, and the third wick structure is disposed in the cover part and faces the base part.

27. The heat dissipation device according to claim 2, wherein the second wick structure has a protruding portion which protrudes from a side edge of the opening of the pipe body and is coupled to the first wick.

28. A heat dissipation device, comprising:

a vapor chamber including a heat conduction chamber, wherein the heat conduction chamber includes a base part and a cover part, the base part includes a base portion and a surrounding portion, base portion and the surrounding portion cooperatively define a recessed space, a side of the surrounding portion includes a recessed portion, and the surrounding portion is disposed along a periphery of the base portion, and a first wick structure is disposed in the heat conduction chamber and directly contacts the base portion;

a heat pipe including a pipe body disposed in the recessed portion of the heat conduction chamber and an opening of the pipe body is flush with a surface of the surrounding portion that faces the recessed space and the pipe body does not protrude into the recessed space, the pipe body being a tubular structure that is flattened at diametrically opposite sides thereof, and including two longitudinally opposite sides that are flattened and that are connected to each other by two laterally opposite curved sides, and a second wick structure disposed on one or both longitudinally opposite sides of the pipe body, wherein when disposed on one longitudinal side, the second wick structure is disposed only on one longitudinal side, and when disposed on both longitudinal sides, two portions forming the second wick structure are separated from each other; and a bonding layer having a porous structure, wherein the bonding layer bonds the first wick structure and the second wick structure to each other.

29. A method of manufacturing a heat dissipation device, comprising:

providing a vapor chamber having a heat conduction chamber and a first wick structure, wherein the heat conduction chamber includes a base part, the base part includes a base portion and a surrounding portion, base portion and the surrounding portion cooperatively define a recessed space, the surrounding portion includes a recessed portion, and the surrounding portion is connected to and disposed along a periphery of the base portion, and the first wick structure is disposed in the base part and directly contacts the base portion;

coupling a heat pipe including a second wick structure to the vapor chamber, an opening of the heat pipe being flush with a surface of the surrounding portion that faces the recessed space and the heat pipe does not protrude into the recessed space the pipe body being a tubular structure that is flattened at diametrically opposite sides thereof, and including two longitudinally opposite sides that are flattened and that are connected to each other by two laterally opposite curved sides, and the second wick structure disposed on one or both longitudinally opposite sides of the heat pipe, wherein when disposed on one longitudinal side, the second wick structure is disposed only on one longitudinal side, and when disposed on both longitudinal sides, two portions forming the second wick structure are separated from each other;

providing a metal powder to cover at least part of the first wick structure and at least part of the second wick structure; and performing a sintering process to transform the metal powder into a bonding layer to metallically bond the first wick structure and the second wick structure to each other.

30. A method of manufacturing a heat dissipation device, comprising:

providing a vapor chamber having a heat conduction chamber and a first wick structure, wherein the heat conduction chamber includes a base part, the base part includes a base portion and a surrounding portion, base portion and the surrounding portion cooperatively define a recessed space, the surrounding portion includes a recessed portion, and the surrounding portion is connected to and disposed along a periphery of the base portion, and the first wick structure is disposed in the base part and directly contacts the base portion;

coupling a heat pipe including a second wick structure to the vapor chamber, an opening of the heat pipe being flush with a surface of the surrounding portion that faces the recessed space and the heat pipe does not protrude into the recessed space, the pipe body being a tubular structure that is flattened at diametrically opposite sides thereof, and including two longitudinally opposite sides that are flattened and that are connected to each other by two laterally opposite curved sides, and the second wick structure being disposed on one or both longitudinally opposite sides of the heat pipe, wherein when disposed on one longitudinal side, the second wick structure is disposed only on one longitudinal side, and when disposed on both longitudinal sides, two portions forming the second wick structure are separated from each other;

providing a metal powder to cover at least part of the first wick structure and at least part of the second wick structure; and performing a sintering process to transform the metal powder into a porous structure to connect the first wick structure and the second wick structure to each other.

* * * * *